United States Patent [19]

Masuda

[11] 4,403,850

[45] Sep. 13, 1983

[54] COPYING DEVICE HAVING PLURAL EXPOSURE MODES

[75] Inventor: Shunichi Masuda, Tokyo, Japan

[73] Assignee: Canon Kabushiki Kaisha, Tokyo, Japan

[21] Appl. No.: 284,139

[22] Filed: Jul. 16, 1981

[30] Foreign Application Priority Data

Jul. 25, 1980 [JP] Japan ..... 55-102581

[51] Int. Cl.[3] ..... G03G 15/00

[52] U.S. Cl. ..... 355/14 R; 355/3 R; 355/14 C

[58] Field of Search ..... 355/14 R, 14 C, 3 R

[56] References Cited

U.S. PATENT DOCUMENTS 4,099,860 7/1978 Connin ..... 355/14 C 4,344,697 8/1982 Matsumoto et al. ..... 355/14 C

*Primary Examiner*—A. C. Prescott

*Attorney, Agent, or Firm*—Fitzpatrick, Cella, Harper & Scinto

[57] ABSTRACT

A copying machine including a mechanism which performs copying in scan mode where the original is exposed while it is being fed; a mechanism which performs copying in scan mode produced by reciprocally moving members; a component of selecting said scan mode; a means enabling the latter scan mode copying by interrupting the copying in the former scan mode; and a function enabling reopening the former scan mode copying after ending said the latter scan mode copying.

13 Claims, 15 Drawing Figures

COPYING DEVICE HAVING PLURAL EXPOSURE MODES

BACKGROUND OF THE INVENTION

1. Field of the Invention

This invention relates to a copying device having a plural number of original exposure modes.

2. Description of the Prior Art

Until today, there have been single mode copying machines which are capable of performing copying only in the scan mode (hereafter called the book mode) in which the original receives slit exposure from reciprocally moving members and which uses a means of stopping once the copying operation being executed if the use of high priority copy is requested in the midst of running numerous number of copies, memorizing the copying state (set number of sheets of copies and number of sheets of paper ended with copying), making the high priority copying operation interrupt to perform copying, and, after ending the interruption copying, returning the device to the copying state being executed before the interruption.

However, for example, in a dual mode copying machine having, beside the above-mentioned book mode, the original scan mode where slit exposure is made by fixed optical system while feeding the original, when other mode copying having high priority is requested while the machine is copying in predetermined mode, the copying at that point is stopped by either depressing the copy stop key to stop the copying being executed or depressing the interruption key to stop the copying being executed, and other mode copying is performed.

In this case, if the stop key is depressed, the copying state being executed is cleared and, to prevent this trouble, a complex operation to depress the interruption key without fail is focused to be done by the user.

Moreover, in order to perform interruption which corresponds to scan modes a plural number of interruption keys must be provided depending on the kinds of interruption.

Further, in conventional copying devices having different copying modes, separate displayers must be provided which correspond to individual copying modes selected by copying mode selecting means, etc.

SUMMARY OF THE INVENTION

It is an objection of this invention to provide a copying device which has a plural number of original exposure modes, such as scan mode and varying size copying mode without having the defects of prior art mentioned above.

More in detail, it is an objection of this invention to provide a copying device having a 1st process means in sheet mode, 2nd process means in book mode, a means of selecting scan mode, a means of stopping the copying of 1st scan mode and enabling 2nd scan mode copying to be performed, and a means of enabling the reopening of the 1st scan mode copying after ending the 2nd scan mode copying.

It is a further objection of this invention to provide a copying device in which the 1st mode copying is stopped by the selection of second mode while the 1st mode copying is being executed and the 2nd mode copying is made possible, and, after ending the 2nd mode copying, the remaining copying in the 1st mode copying is made excutable.

It is a further objection of this to provide offering a copying device in which the information concerning the 1st mode is stored by the selection of 2nd mode while the 1st mode copying is being executed, the 2nd mode copying is made possible, and after ending the 2nd mode copying, the stored information concerning the 1st mode is recalled and the copying by this information is made possible.

It is a further objection of this invention to provide a copying device which is characterized by making the change in image exposure mode of the copying device which is executing copying possible in the 1st mode and impossible in the 2nd mode.

It is a further objection of this invention to provide a copying device which switches the display content of the display means corresponding to the selected mode without providing individual display means of the selected copying modes.

DETAILED DESCRIPTION OF THE PREFERRED EMBODIMENTS

Figure 1:
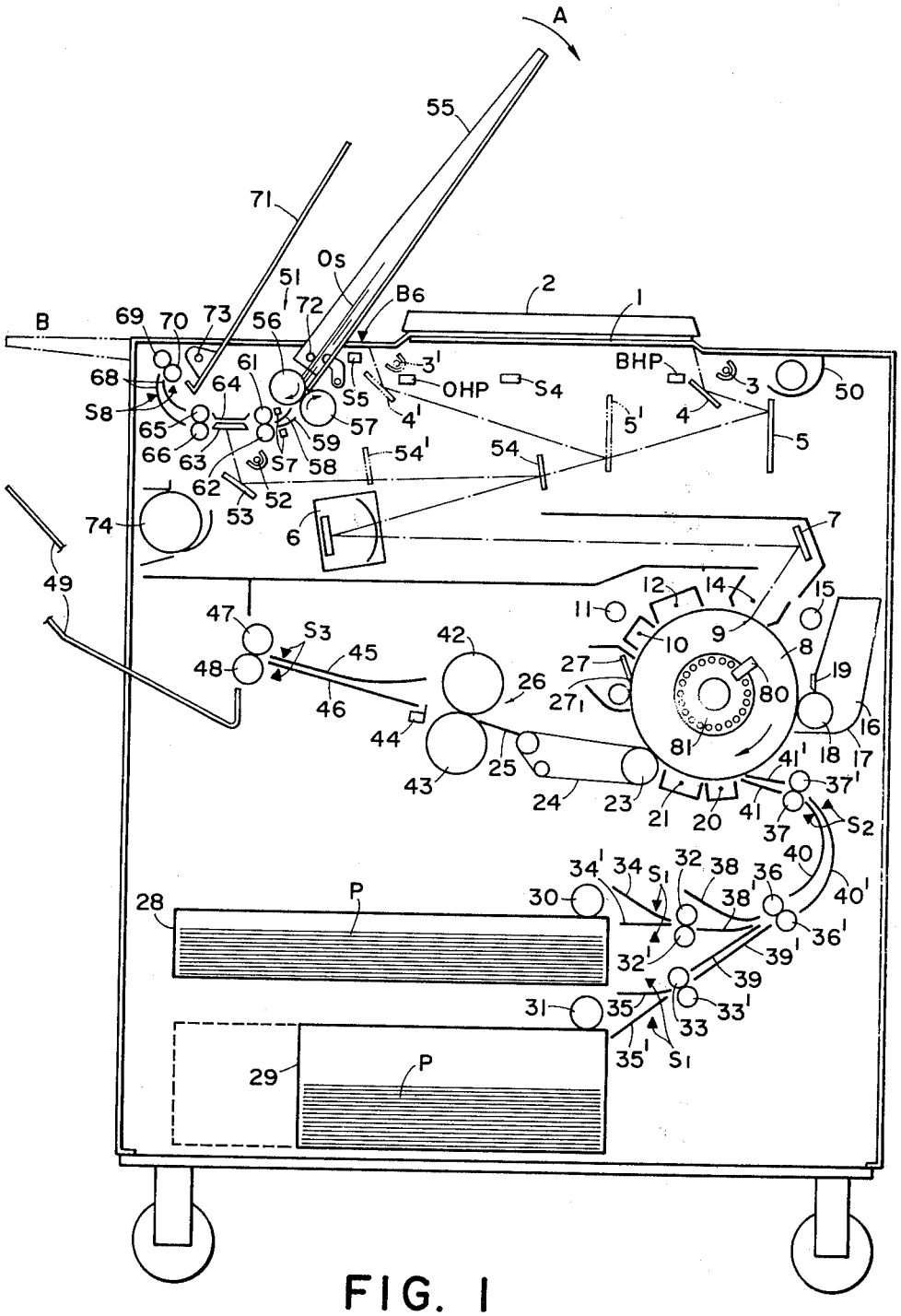
FIG. 1 is the cross sectional view of an example of the invented copying device.

Hereafter an example of copying device to which this invention is applicable will be described referring to FIG. 1.

This copying device is an electronic photographic copying machine of powder development transcription system. In FIG. 1, 1 is a transparent original accepting table. The original to be copied but not shown in the drawing is placed on said original accepting table by aligning its end to the reference position on the table. The original is pressed to the table by a original cover 2. Beneath the original accepting table 1, there are arranged at positions shown with solid lines the original illuminating lamp 3, moving mirrors 4 and 5, fixed in-mirror lens 6, mirror 7, and photosensitive drum 8. Moreover the fan 50 is arranged to cool the original accepting table which is heated by original illuminating lamp. When the copy button not shown in the drawing is depressed, said photosensitive drum 8 starts clockwise rotation as shown in the drawing, charged and receives light illumination by each charger and from each lamp described later and, at the same time, the original illuminating lamp 3, moving mirrors 4 and 5, which are the moving sections of the optical system, move to the positions shown in the drawing with broken lines. When the photosensitive drum has completed its predetermined revolution, the exposure start signal is issued, and said original illuminating lamp 3 and the 1st mirror 4 start movement from positions shown with broken lines toward right at the same speed as the rotary speed and the 2nd mirror 5 also starts movement from the position shown with broken lines toward right at half the speed. The image of the original illuminated from below by said original illuminating lamp 3 is formed on the photosensitive drum 8 by the optical system comprising moving mirrors 4 and 5, in-mirror lens 6, mirror 7, etc. in exposure section 9. When exposure is completed by signals corresponding to the copying size, said original illuminating lamp 3, moving mirrors 4 and 5 stop rightward motion shown in the drawing, return in backward direction or leftward direction shown in drawing, and repeat said operation until completing the copying number of copies specified corresponding to the number of copies designated in advance by the button not shown in the drawing. When the exposure of designated number of copies has been ended, the original illuminating lamp 3 and moving mirrors 4 and 5 return to predetermined positions shown with solid lines in the drawing and stop motion. Moreover, said leftward moving speed shown in the drawing is made to be faster than the rightward moving speed shown in the drawing to improve copying efficiency.

The photosensitive drum 8, which consists of a photosensitive layer covered with a transparent insulating layer, rotates in clockwise direction as shown in the drawing and as described before. The photosensitive drum 8 is first AC deelectrified by the front AC deelectrifier 10 which is supplied with an AC high-voltage current from the high-voltage source not shown in the drawing and, at the same time, exposed to the lamp 11. The residual charges on the surface of the insulating layer and in the photosensitive layer are eliminated and then the photosensitive drum 8 is positively charged by the primary charger 12 which is supplied with positive high-voltage current from a high-voltage source not shown in the drawing. When the photosensitive drum has reached the exposure section 9, the image from the illuminating section is slit exposed and, at the same time, the photosensitive drum is AC deelectrified by the AC deelectrifier 14 which is supplied with an AC high-voltage current from a high-voltage source not shown in the drawing. And then by the overall exposure made next by the lamp 15 an electrostatic latent image is formed on the surface of the photosensitive drum 8. The drum proceeds to the developing unit 16. The developing unit 16, which consists of a developer container 17, developing roller 18, and doctor blade 19, makes the electrostatic latent image on said photosensitive drum 8 visible by using the developer absorbed magnetically to developing roller.

Next, the transcription paper P, which has been sent from the paper feed section, contacts closely with the photosensitive drum 8 in synchronization with the image on the surface of the photosensitive drum 8 and, by the charging at the transcription charger 20 by the positive high-voltage current from the high-voltage source, the image on the photosensitive drum 8 is transcribed on to the transcription paper P. The transcription paper P which has ended transcription is deelectrified by the separation deelectrifier 21 supplied with an AC high-voltage current from the high-voltage source and its absorbing power to the photosensitive drum 8 is weakened. Next, the transcription paper 8 is attracted and separated from the photosensitive drum 8 at section 22 by the roller 23, and led to the fixing section 26 by the belt 24 and guide 25. The photosensitive drum 8 has wiped off the residual developer wiped off by the edge $27_1$, of the blade cleaner 27 pressed against the drum, and repeats the next cycle. After repeating the said cycle for the number of sheets of copies previously designated by the button not shown in the drawing, the photosensitive drum 8 continues rotation further, and stops after the inner charges of photosensitive layer have been removed by the deelectrification by said AC deelectrifier 14 and overall exposure by the lamp 15, and after rotating predetermined amount for preparation for next copying operation.

On the other hand the transcription paper P accommodated in cassette 28 or paper feed deck 29 is accommodated in the paper feed section which is at lower left section of the machine. Cassette 28 is available for each size of the transcription paper, and is interchangeable when required. The paper feed deck 29 is also constructed to store several sizes of transcription paper by simple operation. The transcription paper P accommodated in cassette 28 or paper feed deck 29 is pressed against paper feed rollers 30 and 31 respectively at a predetermined pressure regardless of the quantity. When the photosensitive drum 8 has reached the predetermined position, either the paper feed roller 30 or 31, which was selected in advance by the button not shown in the drawing, starts rotation and sends the transcription paper P to the predetermined position by guides 35, 35', or 34, 34'. The paper feed thereafter is made by a pain of rollers 32, 32' or 33, 33' and subsequent paper feed means. The transcription paper P is led to the photosensitive drum 8 by a pair of rollers 36, 36' 37,37' guides 38, 38' or 39, 39' and 40, 40', 41, 41' and, after synchronizing with the image on the photosensitive drum 8, made to contact closely with the photosensitive drum 8, and the image is transcribed by the charge by the transcription charger 20 as described before. The transcription paper P which has finished transcription is deelectrified by the separation deelectrifier 21 as described before, separated from the photosensitive drum 8 at section 22 and then sent to the fixing section 26 by the roller driven belt 24 and guide 25. In the fixing section 26, the transcription paper P having unfixed image on the surface is fixed by receiving predetermined pressure when passing through between the rollers 42 and 43 which are pressed against each other at predetermined pressure and which rotate at the same rotary speed. The transcription paper P which has left the fixing section 26 is finally removed of residual electric charges remaining on the surface by the deelectrifier 44, led to the discharge rollers 47, 48 by guides 45, 46, and discharged onto the tray 49.

In FIG. 1, the auto feeder section 51, which is installed at the upper section of the copying machine, has as the auto feeder optical system the original illuminating lamp 52, fixed mirror 53, and moving mirror 54. The auto feeder moving mirror 54 is arranged at a position, or the first position shown with broken lines in the drawing, so that the mirror 54 does not interfere with the light path even when in the course of copying operation using the original accepting table 1 described before said original illuminating lamp 3 and moving mirrors 4 and 5 have moved to positions 3', 4' and 5' shown with broken lines in the drawing to expose the original $O_B$ on the original accepting table 1. At time of using the auto feeder, said original illuminating lamp 3 and moving mirrors 4 and 5 stop at positions shown with solid lines in the drawing, the auto feeder moving mirror 54 travels from the 1st position shown with broken lines in the drawing to the right and stops at the 2nd position shown with solid lines. At this time, the auto feeder light path is formed by the auto feeder original illuminating lamp 52, mirror 53, moving mirror 54, inmirror lens 6, and fixed mirror 7. When piled sheet original $O_S$ is placed on the sheet original inserting table 55, the uppermost sheet original $O_S$ is advanced while being separated by the separation and feed rollers 56 and 57 which rotate to send the sheet original in directions shown by arrows opposite to each other, fed to between the guides 58 and 59, detected its tip by sensing element 57, and is stopped once at that position. When the photosensitive drum 8 has rotated to the predetermined position, the sheet original $O_S$ is carried through the space between the guide glass 63, guide plate 64, etc., again by the rollers 56, 57 and rollers 61, 62 in synchronization with the photosensitive drum 8, illuminated by the lamp 52, and the image on the sheet original $O_S$ is formed on the photosensitive drum 8 by the mirror 53, moving mirror 54, inmirror lens 6, and fixed mirror 7. Next, the sheet original $O_S$ is discharged to the original tray 71 by the rollers 65, 66, guides 67, 68, and discharge rollers 69, 70. This operation is performed continuously until there is no sheet original $O_S$ in the sheet original insertion table 55.

Said sheet original insertion table 55 is supported by shaft 72 and the original tray 71 is by shaft 73 so that they can perform predetermined rotation. They are fixed at positions shown with solid lines in the drawing when the autofeeder is used and, when the autofeeder is not used, they can be rotated in counter-clockwise direction shown in the drawing, accommodated to positions shown with broken lines in the drawing, and can be used as the work table. Moreover, the fan 74 is arranged to cool the guide glass 63 which is heated by the autofeeder original illuminating lamp 52.

The use of autofeeder enables copying of long original to be made. Accordingly, sometimes a large-sized cassette is used for long copy. In this example, however, construction is so made as to eliminate useless space in the machine by arranging the accommodating section of the large-sized cassette at the space developed by the machine which is made larger by addition of the autofeeder.

The following two basic operations are needed as the conditions for performing varying size copying with this copying machine.

(1) Correction of light path length with may be changed by the movement of lenses and mirrors or lens replacement and mirror movement in image forming optical system.

(2) Conversion of relative speed between the movement of photosensitive body and scanning of original.

In this copying machine the following operation is performed by using autofeeder optical system to carry out varying size copying at time of using the autofeeder. First said autofeeder original exposure lamp 52 and mirror 53 are left fixed at positions shown in the drawing, the moving mirror 54 and inmirror lens 6 are moved corresponding to the magnification factor to correct the light path length. Then varying size copying is made by satisfying the above mentioned conditions by making the sheet original conveying speed $V_1$ to $V_1 = V/n$, which is obtained by multiplying the speed V of the photosensitive drum 8 by the inverse number of the magnification factor n, by varying the speeds of said separation and feed rollers 56, 57, rollers 61, 62, 65, 66, and discharge rollers 69, 70.

As the signals to control the above-mentioned image forming cycle at each point of time, drum clock pulse DCK is generated by the clock panel 81 which rotates with the rotation of the drum 8 and by the sensor 80 which detects its clock point optically. $S_1$ in the drawing is the sensor group used to detect feed error of the paper fed from the upper stage cassette 28' and lower stage deck 29, $S_2$ is the sensor used to detect jam and slantwise travel of the paper near the transcription section, $S_3$ is the sensor used to detect jam near the fixing section and discharge section, $S_4$ is the sensor to match the resist of the transcription paper and photosensitive drum at the transcription section, $S_5$ is the sensor used to detect that the sheet original tray 55 of the autofeeder has been set, $S_7$ is the sensor used to detect the timing and slantwise travel of the sheet original, and $S_8$ is the sensor used to detect the jam of the sheet original at the discharge section of the outofeeder. Each sensor detects the amount of light which varies with the passing of the paper and moving of the parts and generates signal output.

Figure 2:
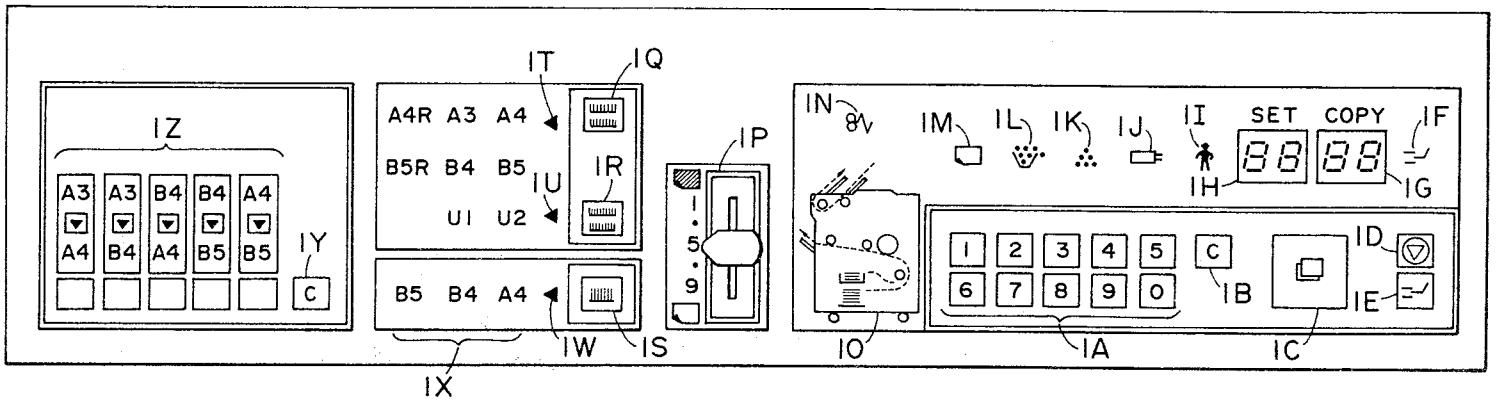
FIG. 2 is the plane view of an example of operation section in the copying device shown in FIG. 1.

FIG. 2 is the plane view of the control section shown in FIG. 1. 1A is the numerical valve key used to set the desired number of copies for one original. 1B is the clear key used to clear the set number of sheet and the number of sheet of copies completed. 1H and 1G are 7 segment displayers which display respectively the set number of sheet and number of sheets copied. Displayer 1H displays the number of sheets set by the key 1A, and numerical displays of the displayers 1H and 1G are cleared by the clear key 1B. 1C is the copy button which directs the start of copying, 1D is the stop key which directs the stop of repeated copying (including the release of interruption by interrupt key), 1Q, 1R and 1S are the cassette selection keys used to select the cassette or paper feed deck which feeds paper, 1T, 1U, and 1W are the displayers used to display the selected stage, 1X is the displayer used to display all time the size of the cassette accommodated in each state, 1E is the interruption key used to execute interruption copying while executing book copying which is effective only in book mode time and if the key is turned on, the interruption displayer 1F goes on, the process being executed at that time is ended, the drum is stopped and the set number of sheets and number of copy ended sheets at that point displayed on the displayers 1H and 1G are sent to and memorized by the memory and, instead, make the displayers 1H and 1G display 01 and 00 respectively. Then interruption copying is started by turning on the copy key 1C, and when the copying is ended, the interruption displayer 1F goes off. When paper jam occurs in the device or when service man call request is being made by other troubles of the device, input cannot be made even when the keys mentioned so far are turned on. 1I through 1N are warning picturized character displayer and they notify the user whether the copying should be or should not be stopped. 1I displays the request for service man call, 1J the absence of key counter, 1K the toner out alarm, 1L the overflow of toner recovery container, 1M the copying paper out, and 1N the jam in the device.

Next key displayers related to sheet mode time will be described.

When the sheet original tray 55 of FIG. 1 is set as shown with solid lines in the drawing, in the main unit it is sensed by the sensor S5 that the sheet original tray has been set and the set displayers 1H and the copy displayer 1G to FIG. 2 display AF and OO respectively.

In the invented device the reduction mode is possible only at sheet mode time. The reduction selection key 1Z is accepted only in sheet mode time. The key 1Y is the key for reduction clearing.

At time of sheet mode the numerical value key 1A is not accepted. Because the sheet mode copy of this device can make only one sheet of copy per sheet original. Therefore in the number of sheets of copy displayers at sheet mode time, the set displayer 1H displays all time AF which informs the use of autofeeder instead of displaying set number of sheets of copies and the copy displayer 1G adds and displays the number of sheets finished with copying.

According to this invention, if the sheet original tray 55 is set to the state (A) shown with solid lines in FIG. 1, the device enters the same state as the interruption key is turned on. In other words, the process being executed at that time is ended, the drum is stopped, the set number of sheets and number of sheets ended with copying being displayed on the displayers at book mode time are saved in and memorized by the memory and, instead, AF and OO are displayed on the displayers 1H and 1G respectively. And, when the sheet mode interruption copying is ended and the sheet original tray is returned to the state (B), the sheet interruption copy is refeased for the first time and continuation of book mode copying before the interruption becomes possible. When the sheet mode is made when the device is in stop state the sheet mode is not handled as interruption. 10 is used to display the place where jam is generated and 1P is the copy density setter.

FIGS. 3A–3D are an example of control block and circuit of the example of copying device according to this invention in which Q1 is the controller consisting of a one-chip microcomputer comprising the memory (ROM) storing control program, the memory (RAM) storing temporarily control data such as flag, input data such as copy set number of sheets, and output data for sequence operation display, latch register (I/O) for outputting load operation signal such as drum motor by inputting key set numbers to CPU, arithmetic logic unit (ALU) which reads input data from input port into CPU and memorizes the data in RAM or decides and which generates a predetermined output from the output port, all of which are formed into one semiconductor element. To the INT input of the controller Q1 is input the drum clock pulse used to control the operation of the controller $Q_1$. $Q_2$ is the key and display controller used to control key input and display of the displayer by command data coming from the controller $Q_1$. $Q_4$ and $Q_5$ are Darlington transistors normally called the hummer drivers which are used to drive each load. For examle when, as shown in FIGS. 3A–3D, the main motor drive signal (A) is output from the output port 1 of the controller $Q_1$, the Darlington transistor $Q_4$ is turned ON and the solid state relay (SSR) connected to the Darlington transistor $Q_4$ is turned on. When the SSR is turned on, AC 100 V is supplied from the power source to the motor MO connected there. As a result the motor MO is turned on and the drum starts to rotate. The Darlington transistor $Q_5$ puts the drive clutch in operation by optical drive signal (C) similar to said Darlington transistor $Q_4$. $Q_3$ is the OR gate used to connect the paper empty (PEP), cassette empty (CEP), key counter empty (KEP) signals, which generate copy wait signal ($S_{10}$) to the input port of $Q_1$.

Figure 4:
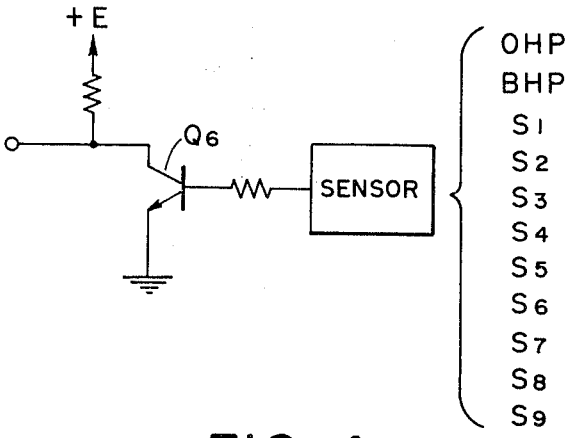
FIG. 4 is an example of sensor circuit.
Figure 6:
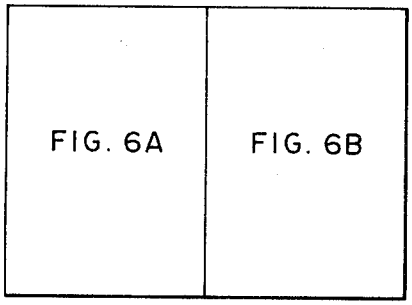
FIG. 6 shows an arrangement of FIGS. 6A and 6B, FIGS. 6A–6B show the operation timing chart at sheet mode time in FIG. 1, in accordance with FIG. 6.
Figure 7:
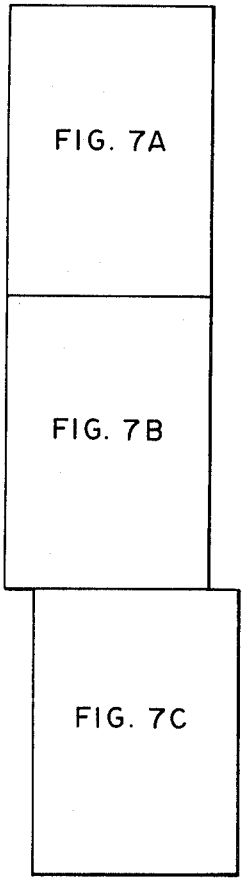
FIG. 7 shows an arrangement of FIGS. 7A–7C.
Figure 9:
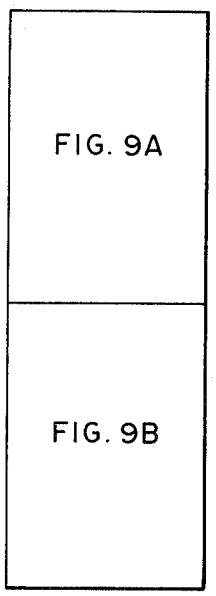
FIG. 9 shows an arrangement of FIGS. 9A–9B, FIGS. 9A–9B show the operation flow charts in FIG. 1 in accordance with FIG. 9.
Figure 8:
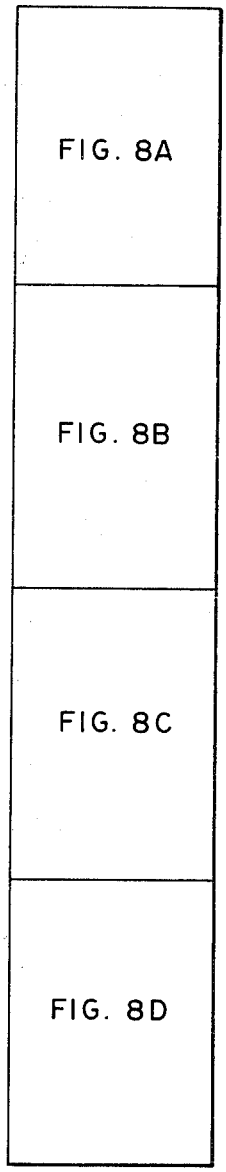
FIG. 8 shows an arrangement of FIGS. 8A–8D.

FIG. 4 shows the detector circuit of sensor corresponding to each singal connected to the input port of $Q_1$.

Figure 5:
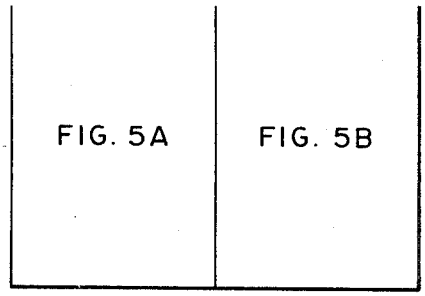
FIG. 5 shows an arrangement of FIGS. 5A and 5B, FIGS. 5A and 5B show the operation timing chart at book mode time in FIG. 1, in accordance with FIG. 5.
Figure 5A:
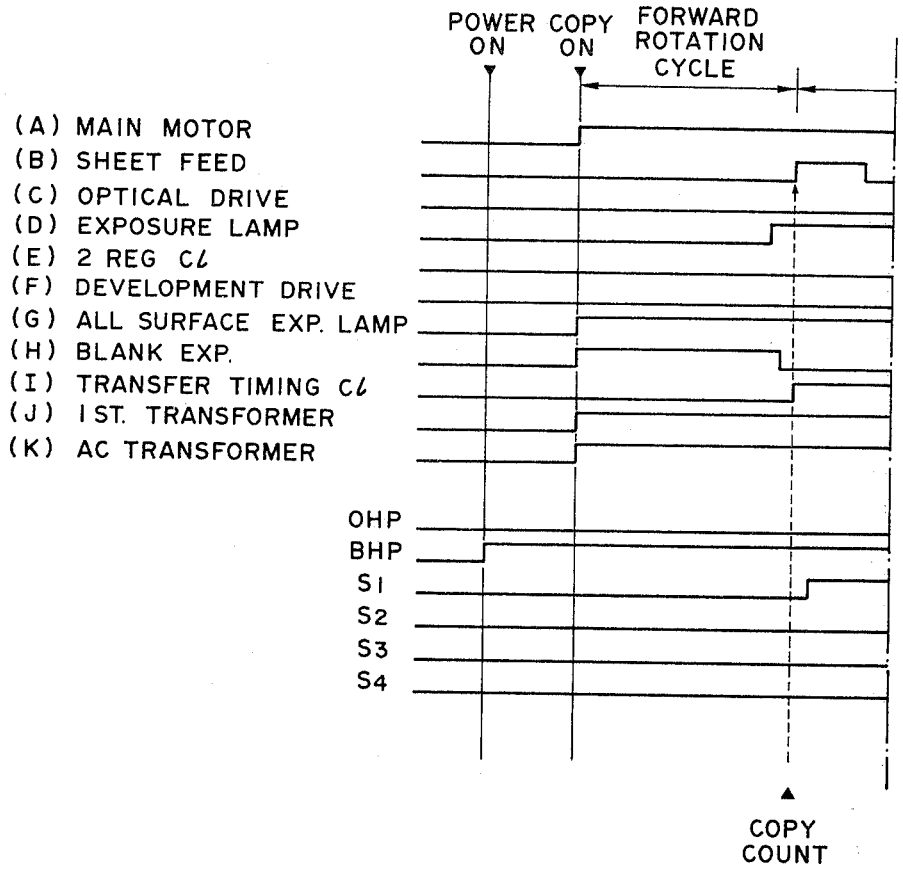
Figure 5B:
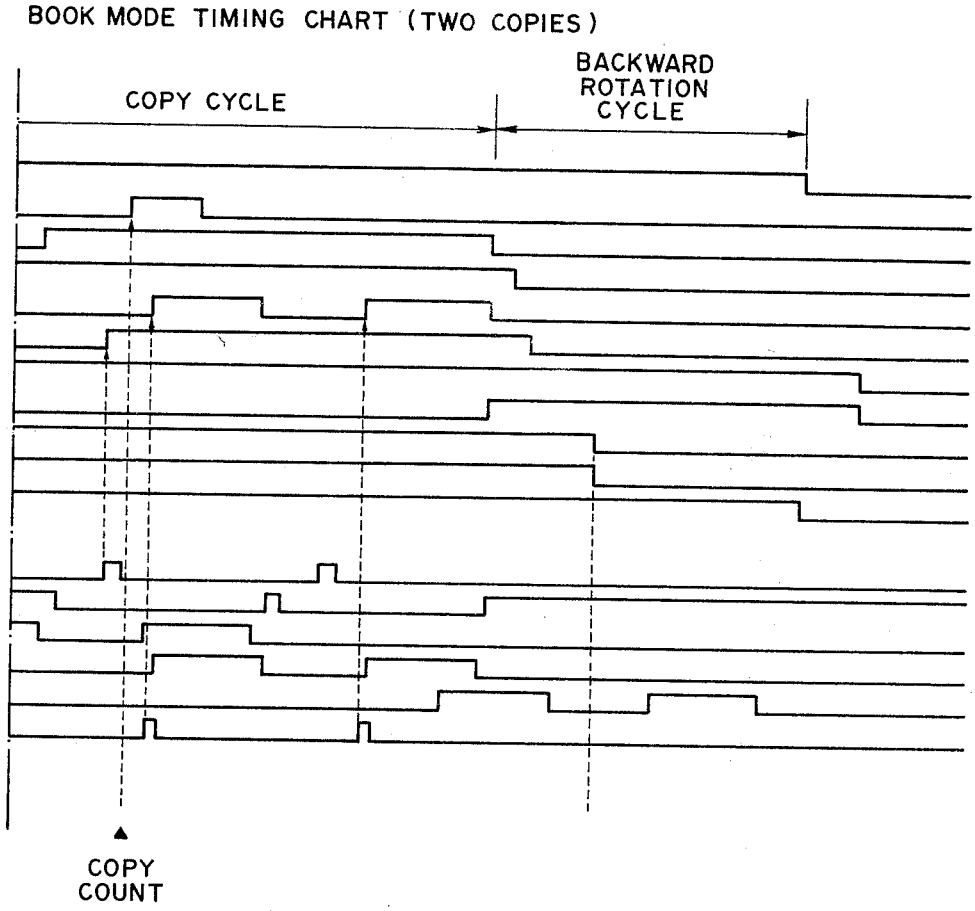
Figure 6A:
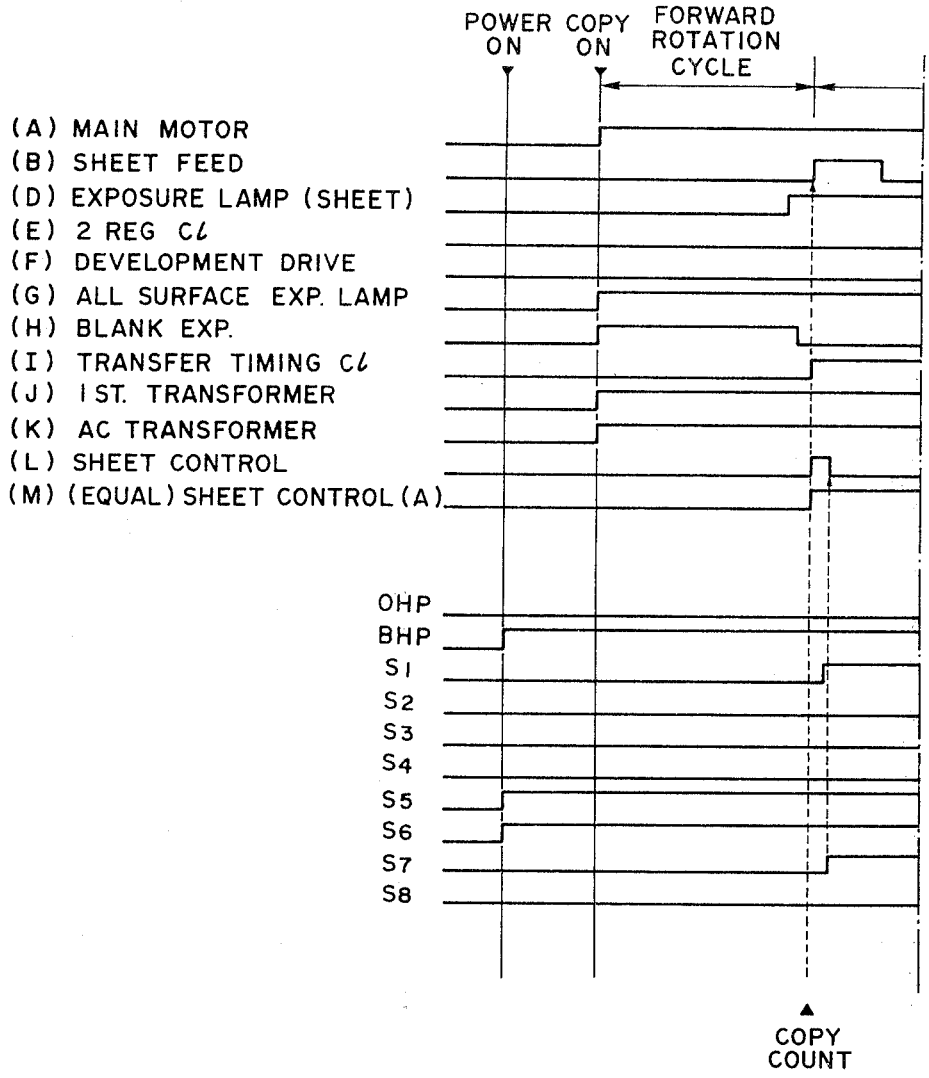
Figure 6B:
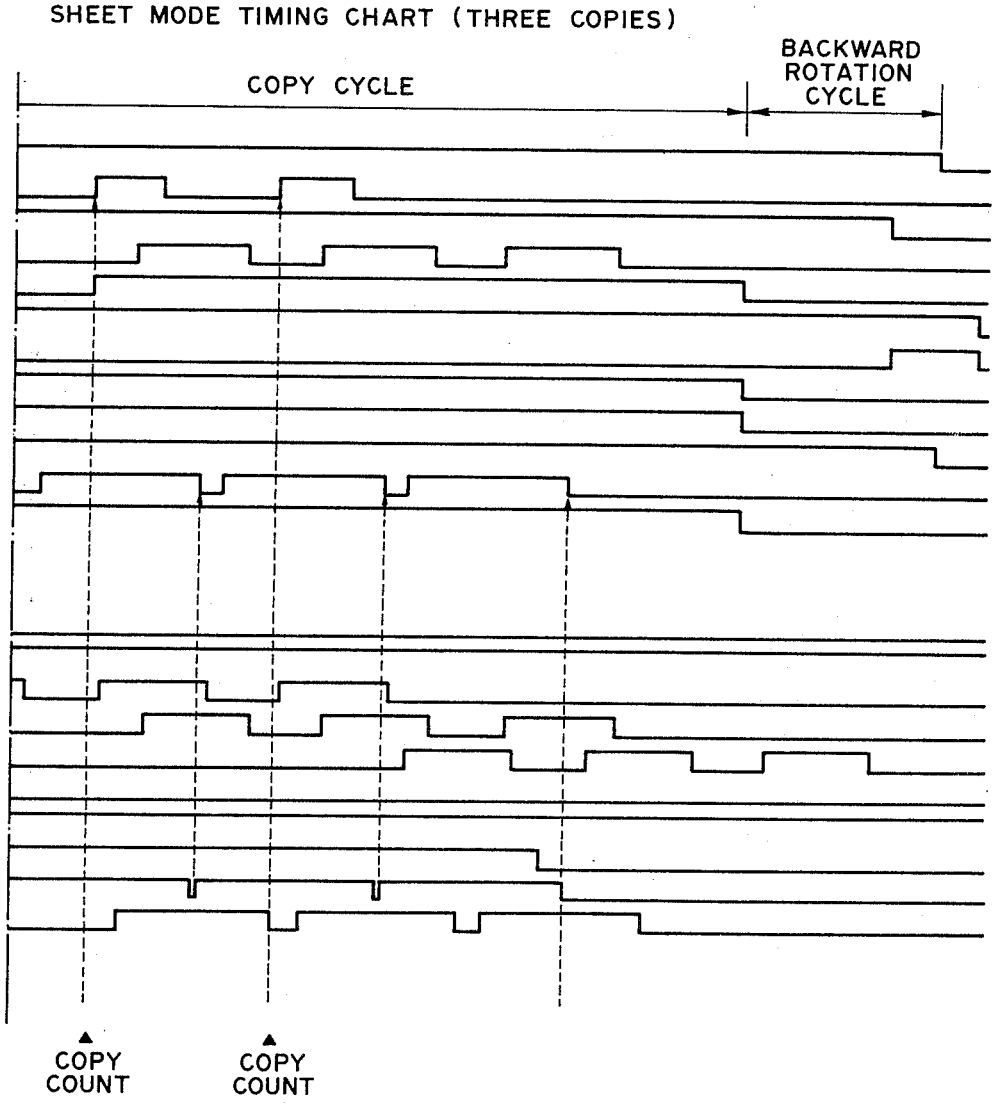
Figure 7A:
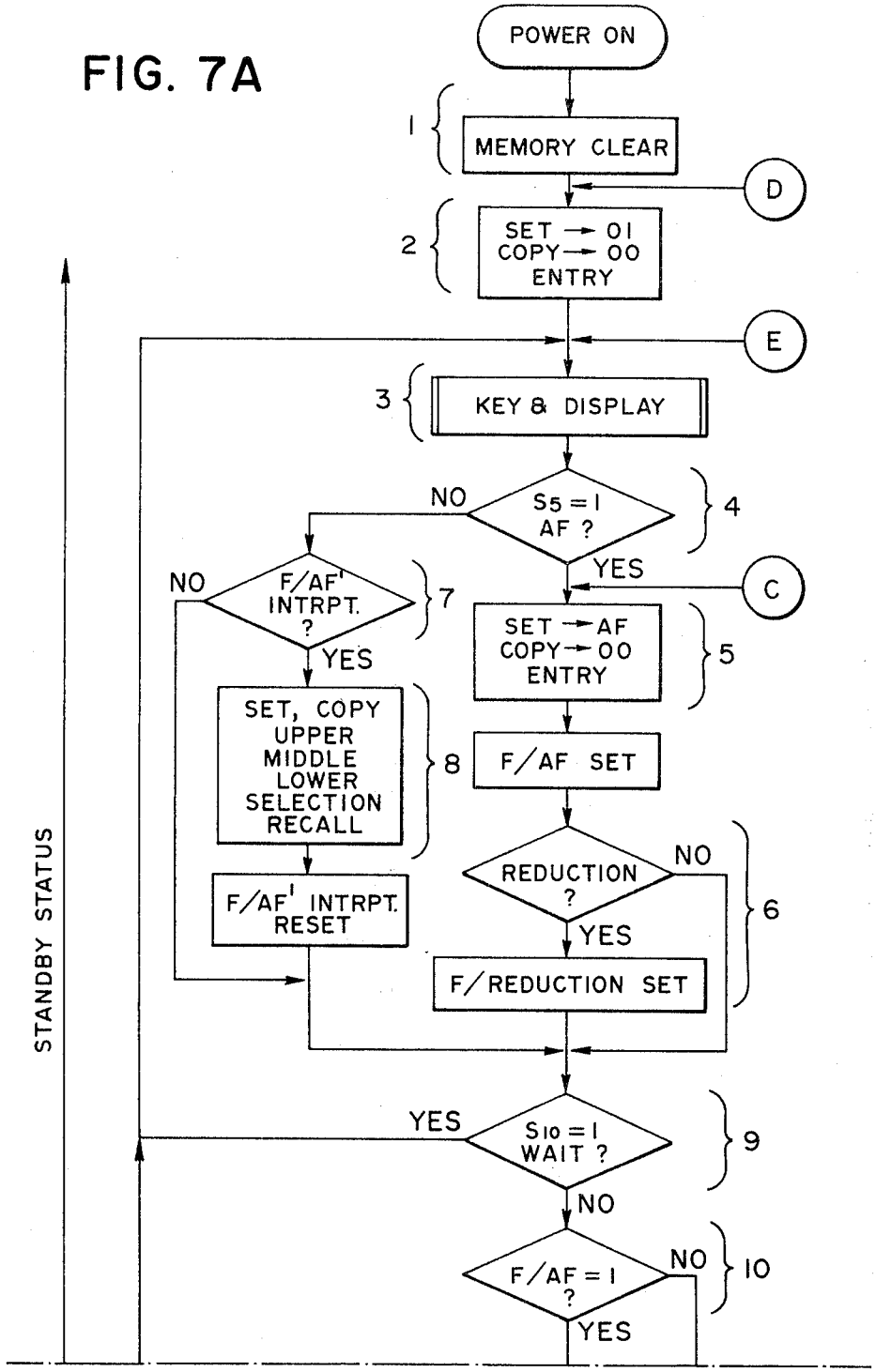
FIGS. 7A–7C show the operation flow charts in FIG. 1 in accordance with FIG. 7.
Figure 7B:
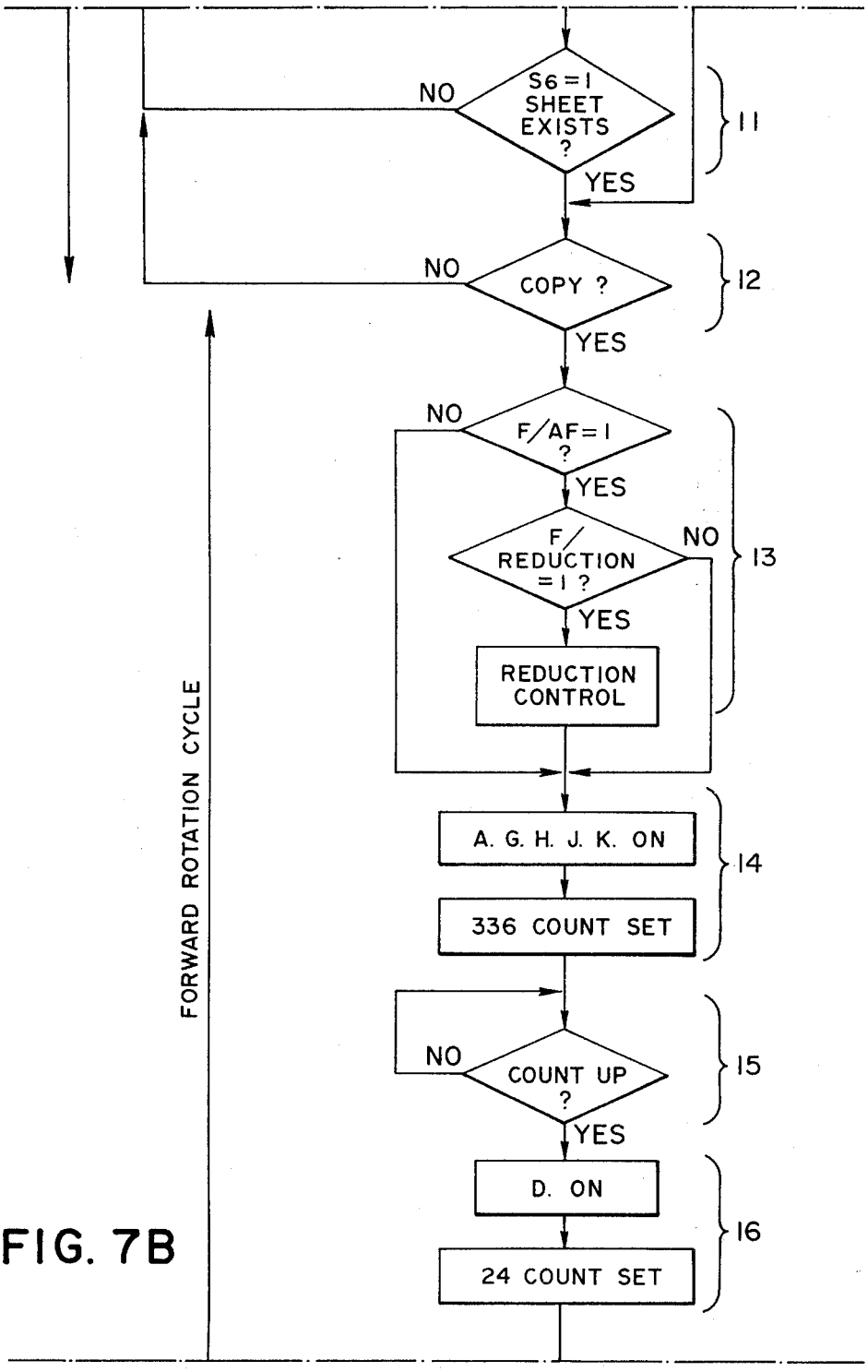
Figure 7C:
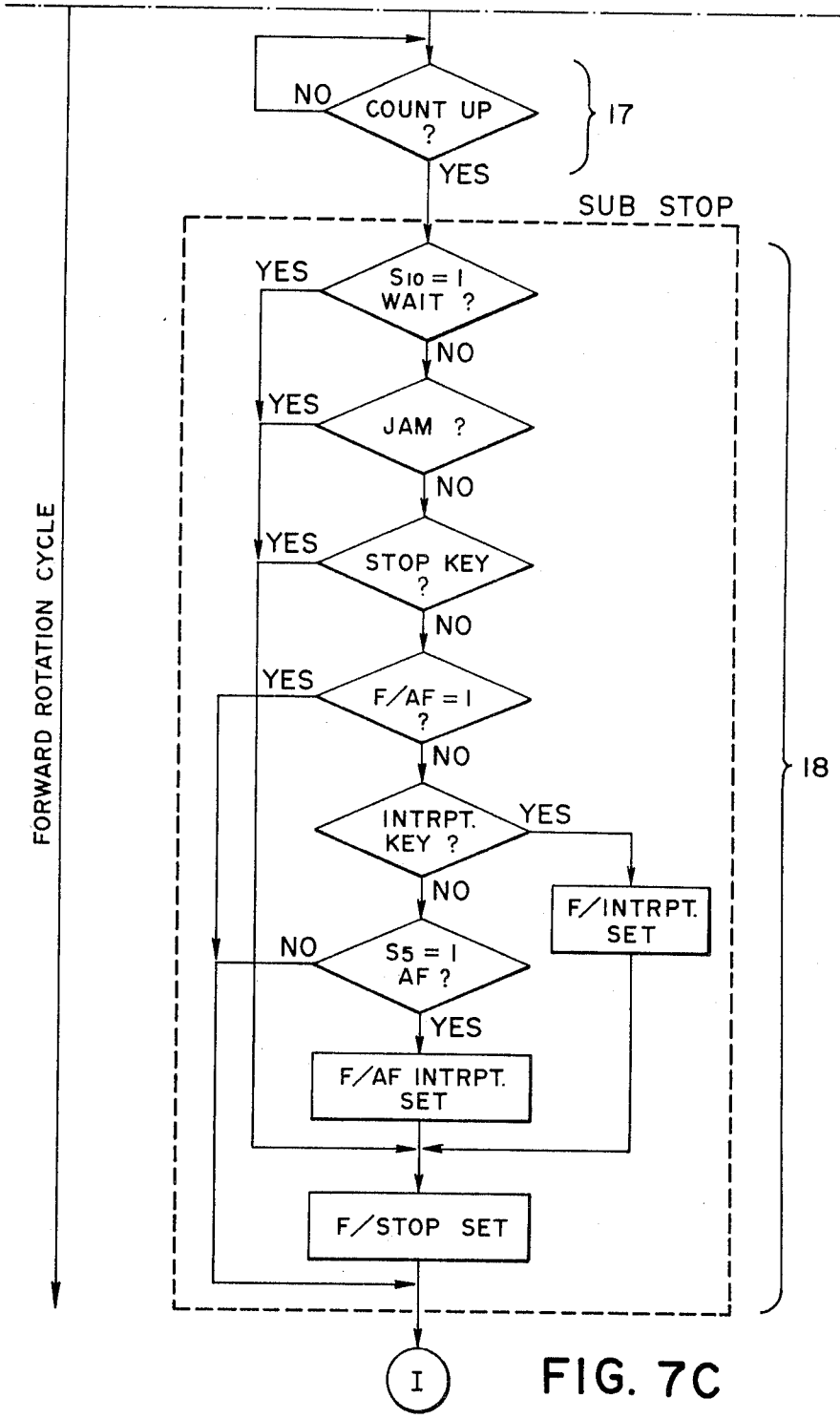
Figure 8A:
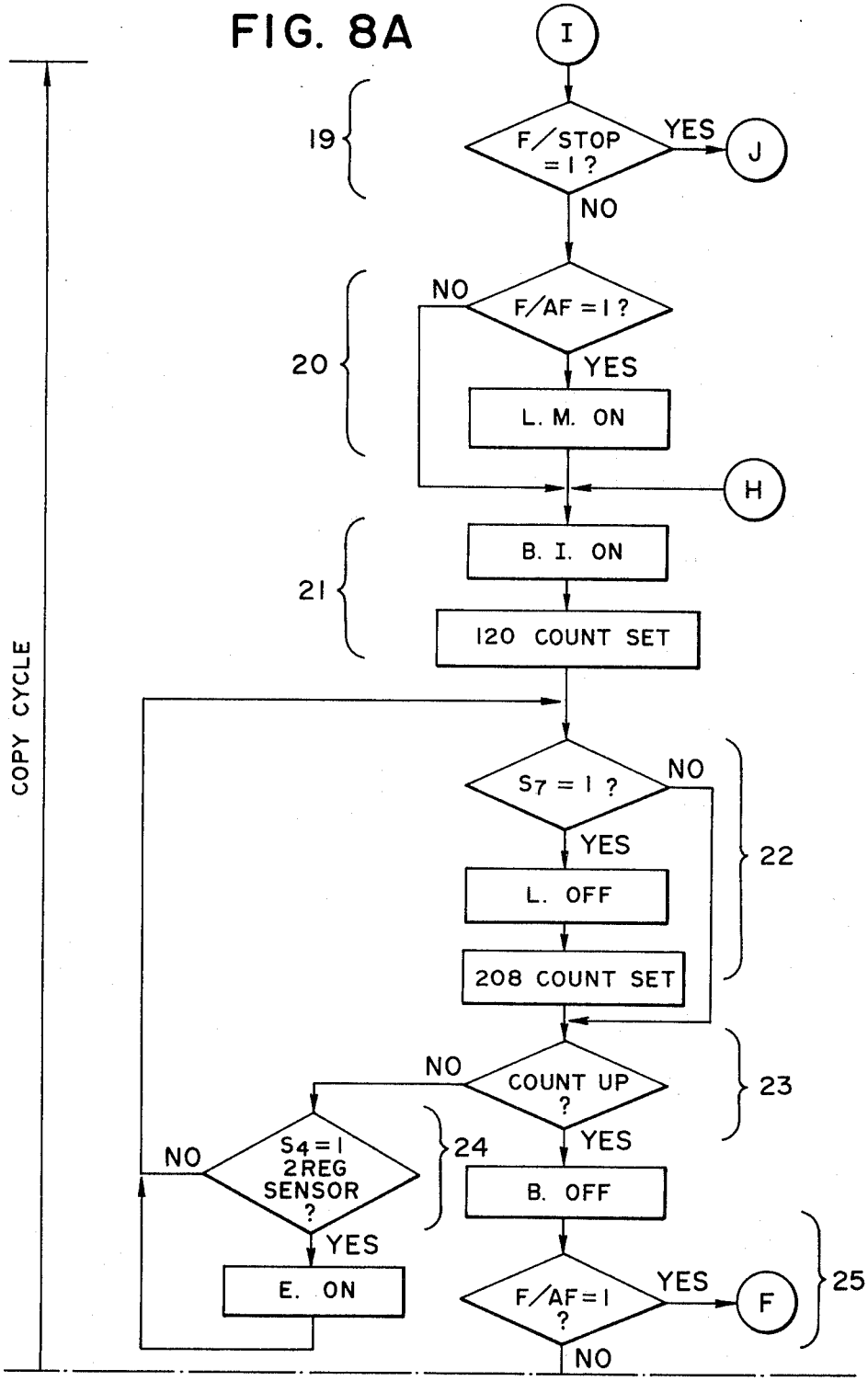
FIGS. 8A–8D show the operation flow charts in FIG. 1 in accordance with FIG. 8.
Figure 8B:
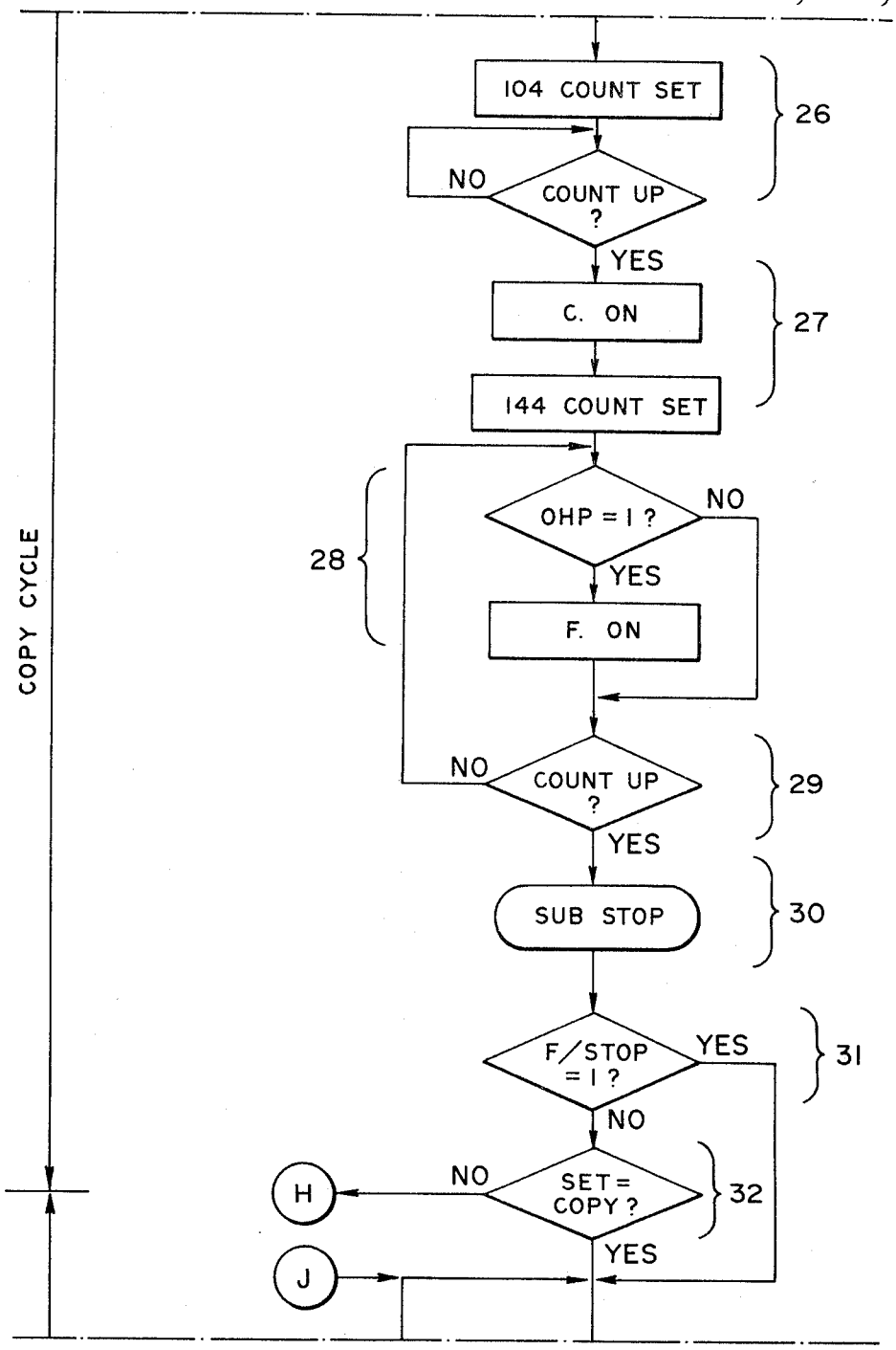
Figure 8C:
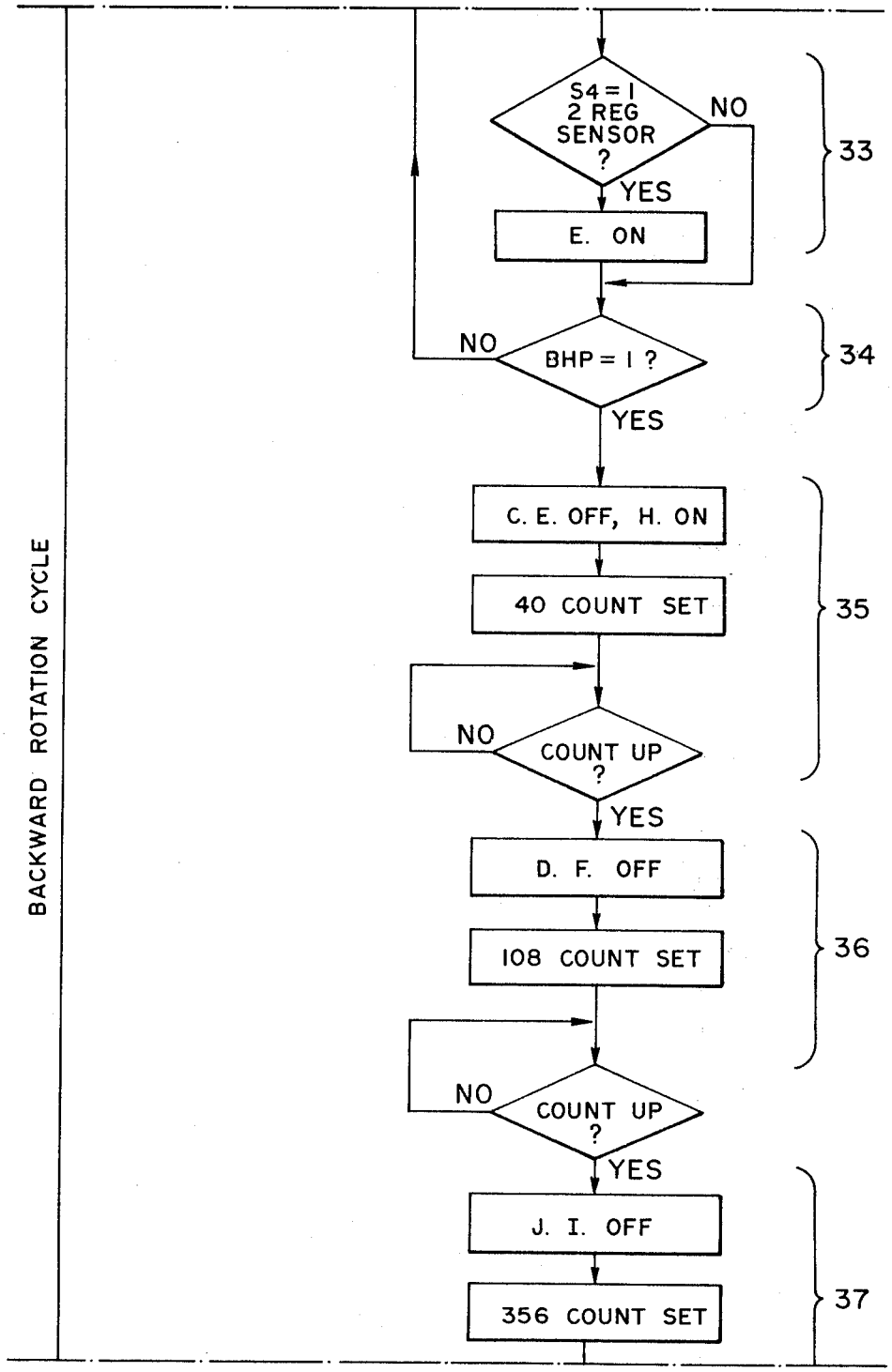
Figure 8D:
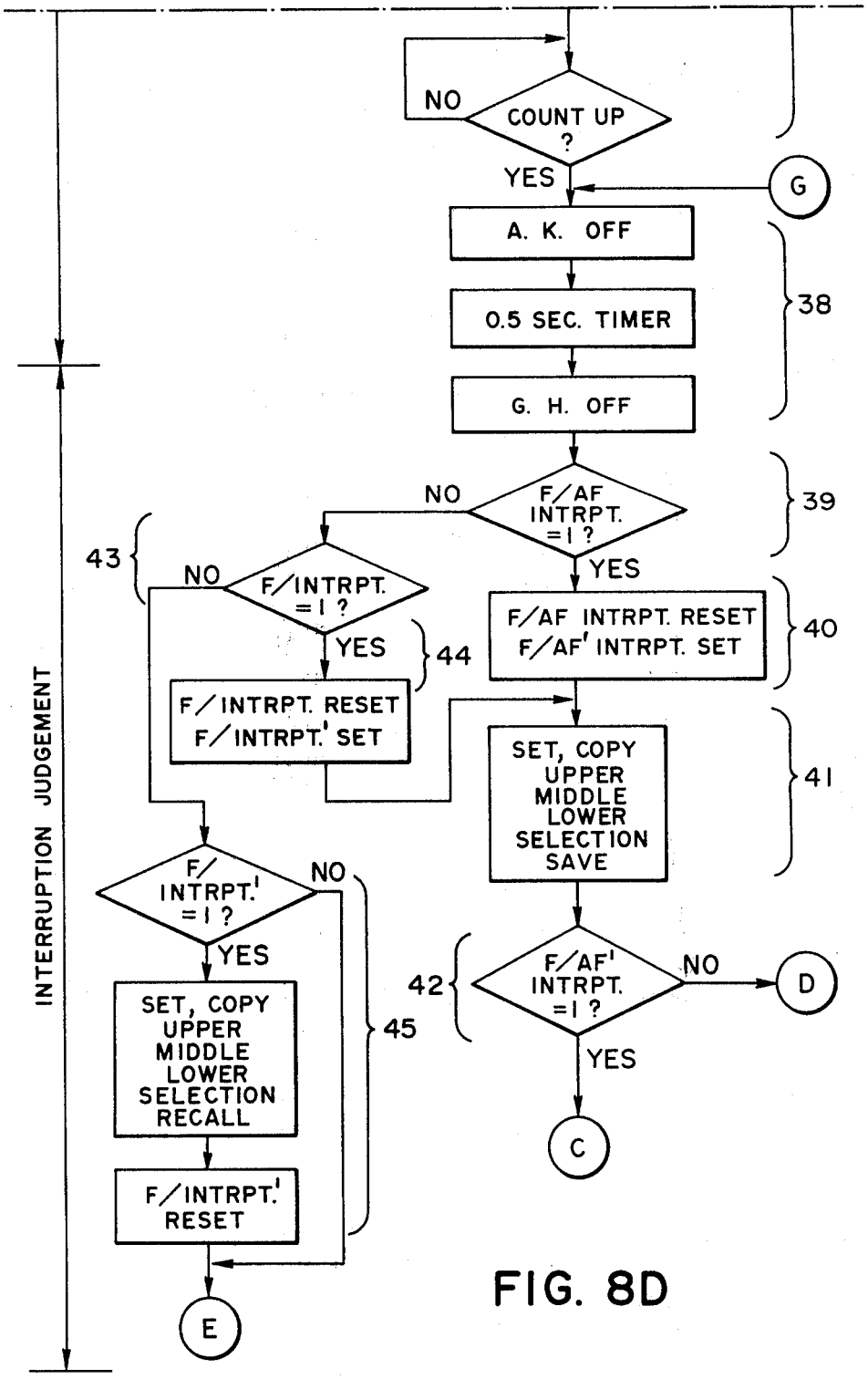
Figure 9A:
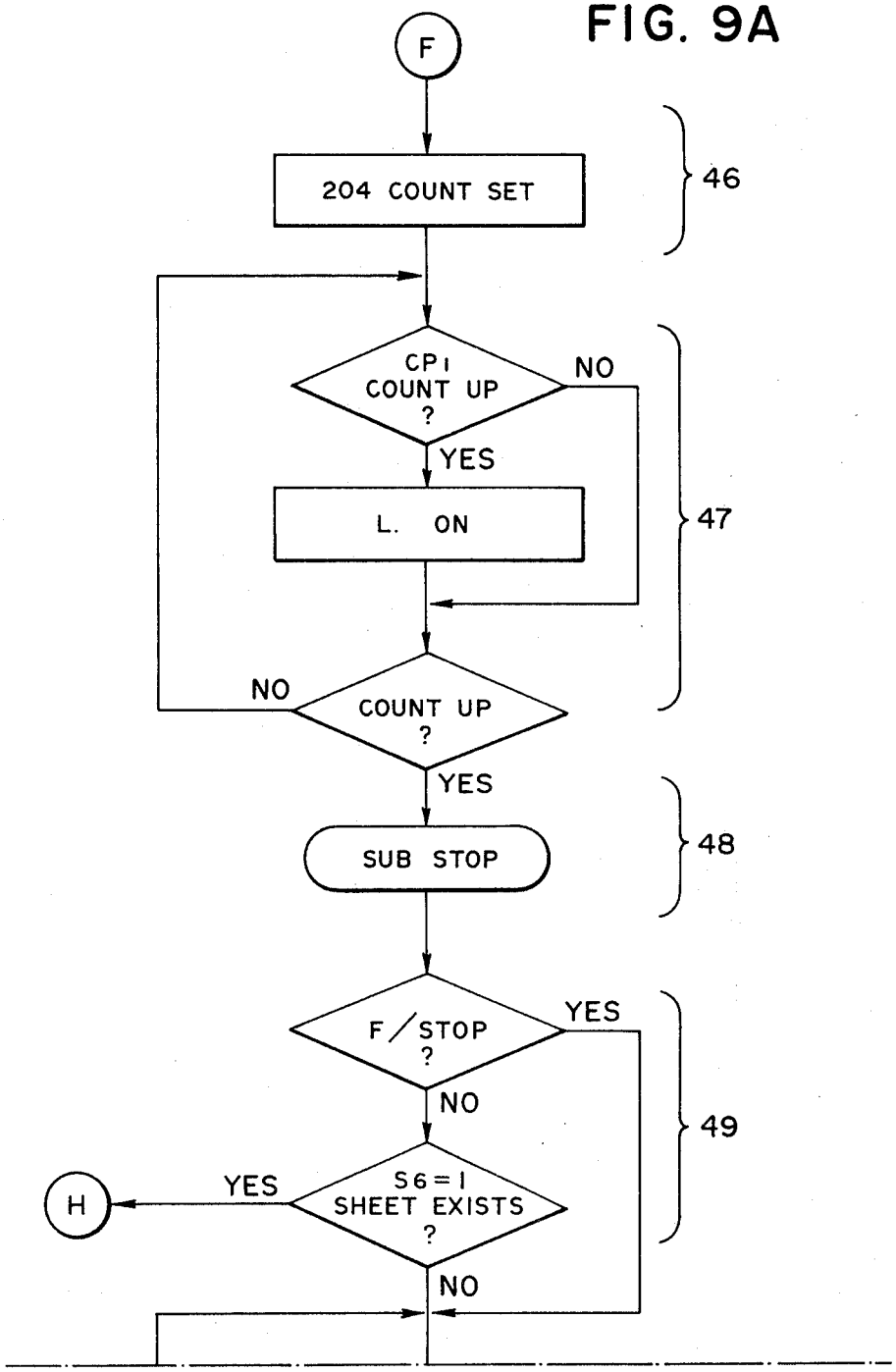
Figure 9B:
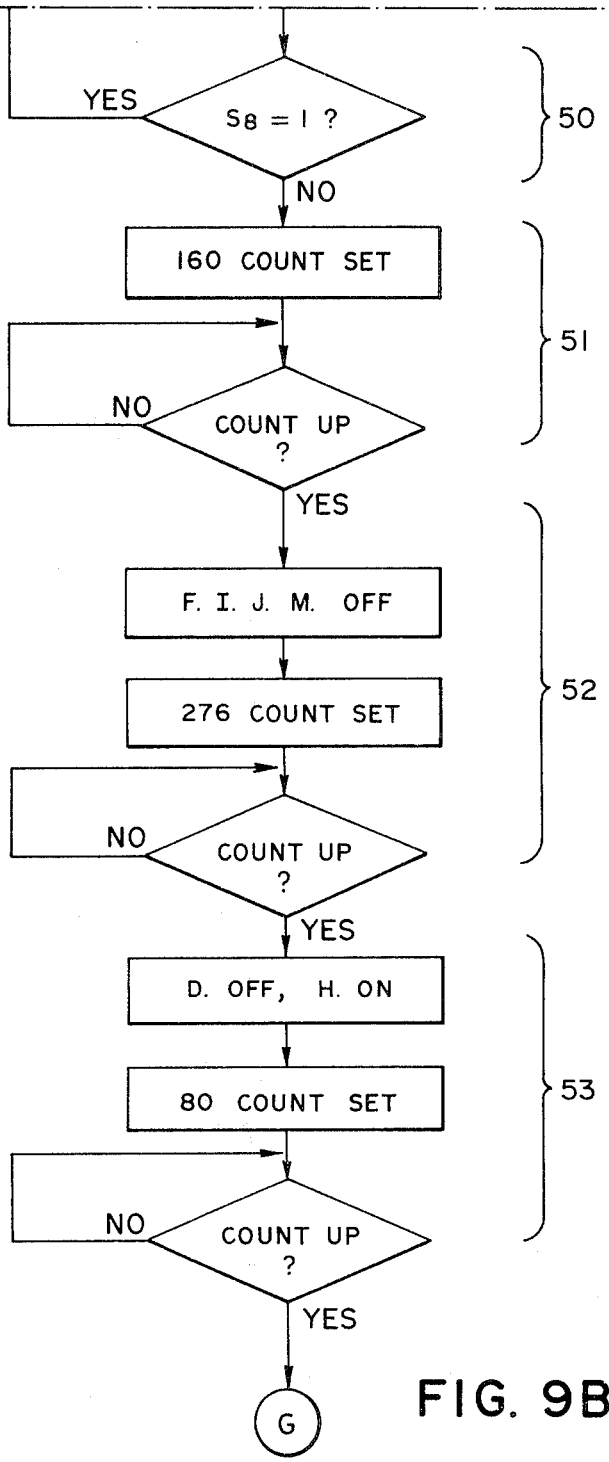

FIGS. 5A and 5B show the operation timing chart of the invented image forming device at book made time, and FIGS. 6A and 6B are the operation timing chart at sheet mode time.

Figure 3:
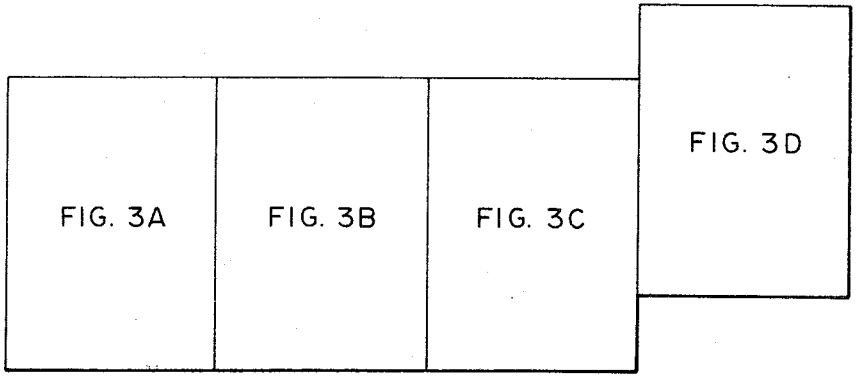
FIG. 3 shows an arrangement of FIGS. 3A–3D, FIGS. 3A–3D show the control block and example of circuit in FIG. 1, in accordance with FIG. 3.
Figure 3A:
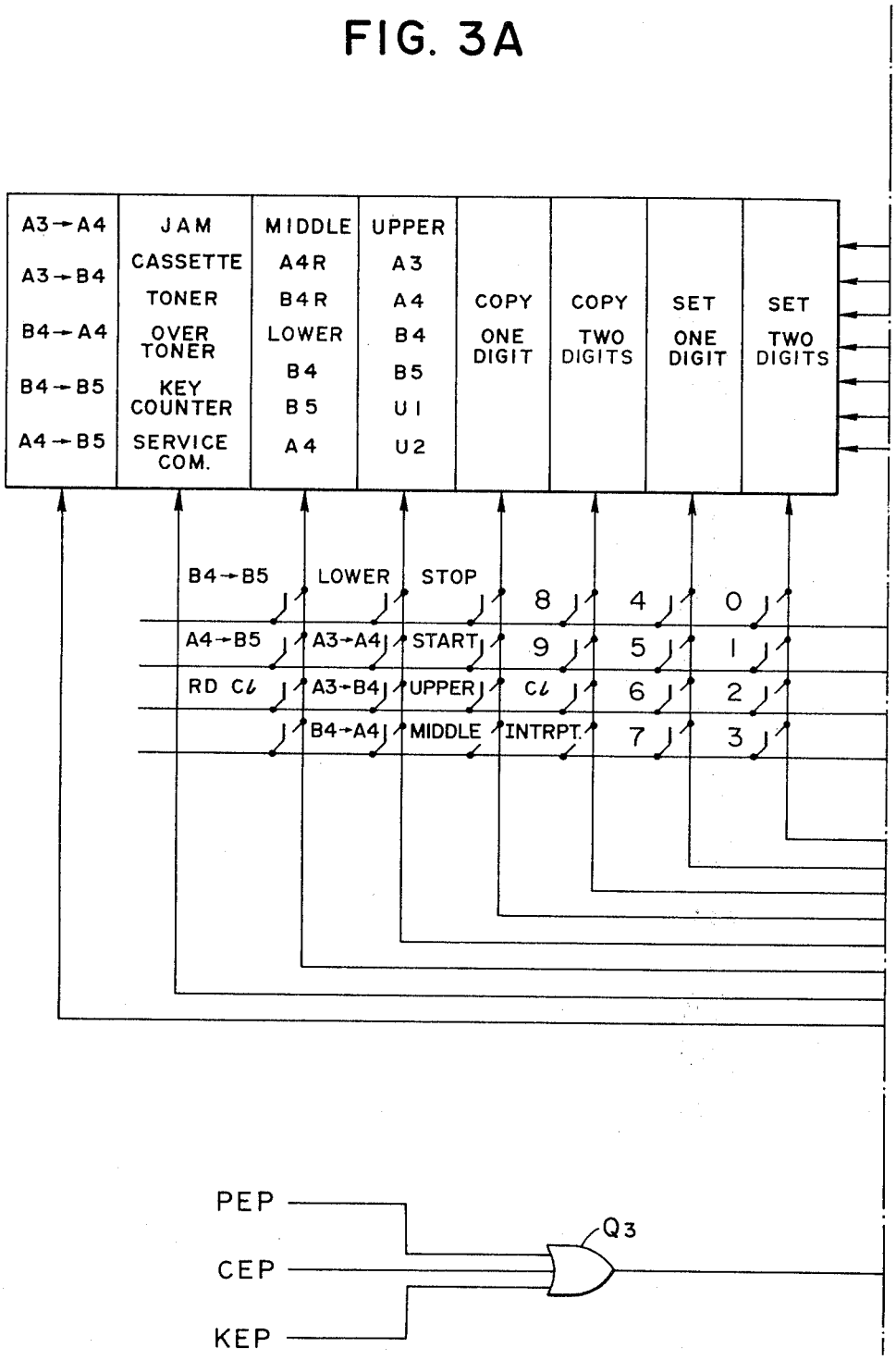
Figure 3B:
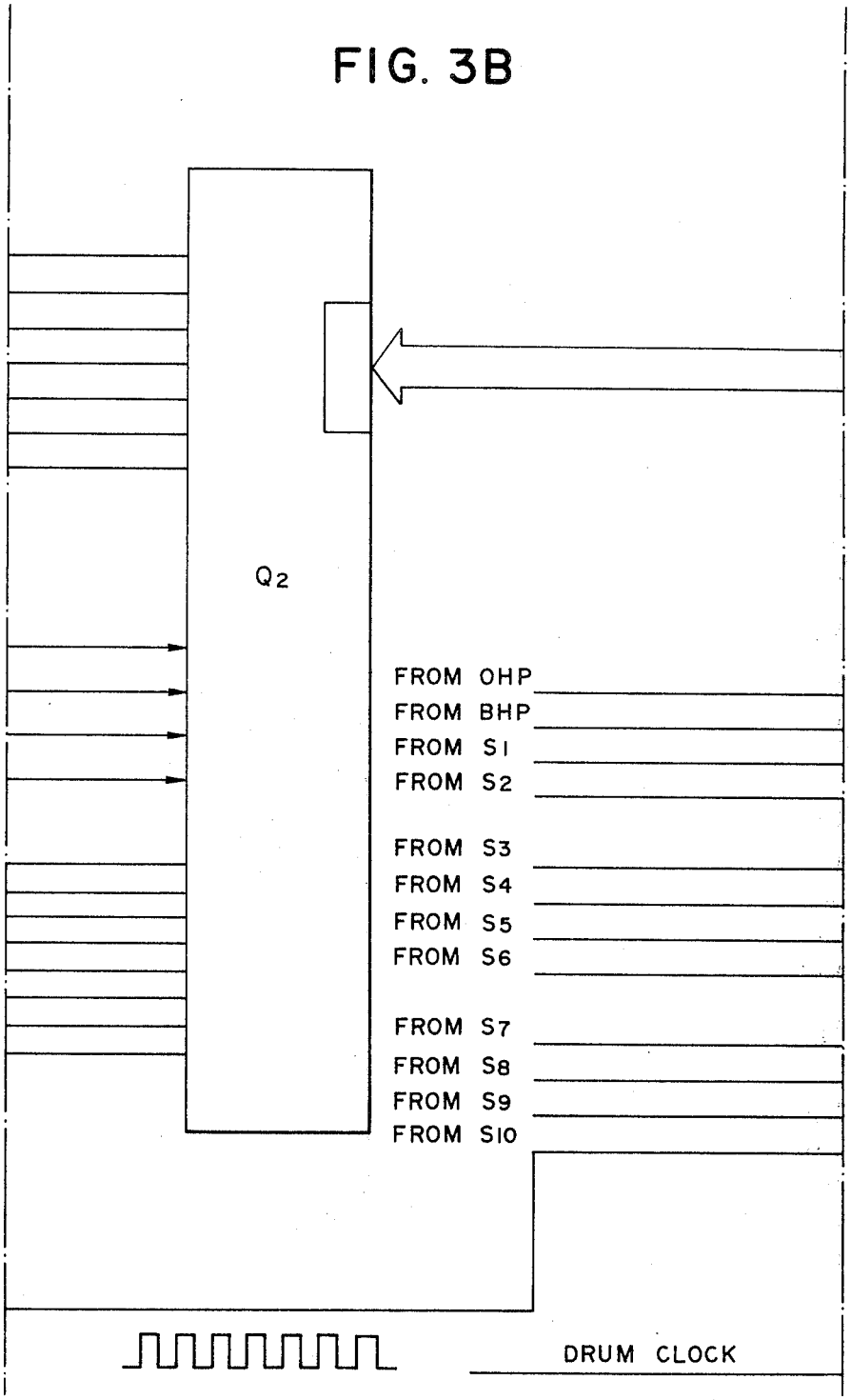
Figure 3C:
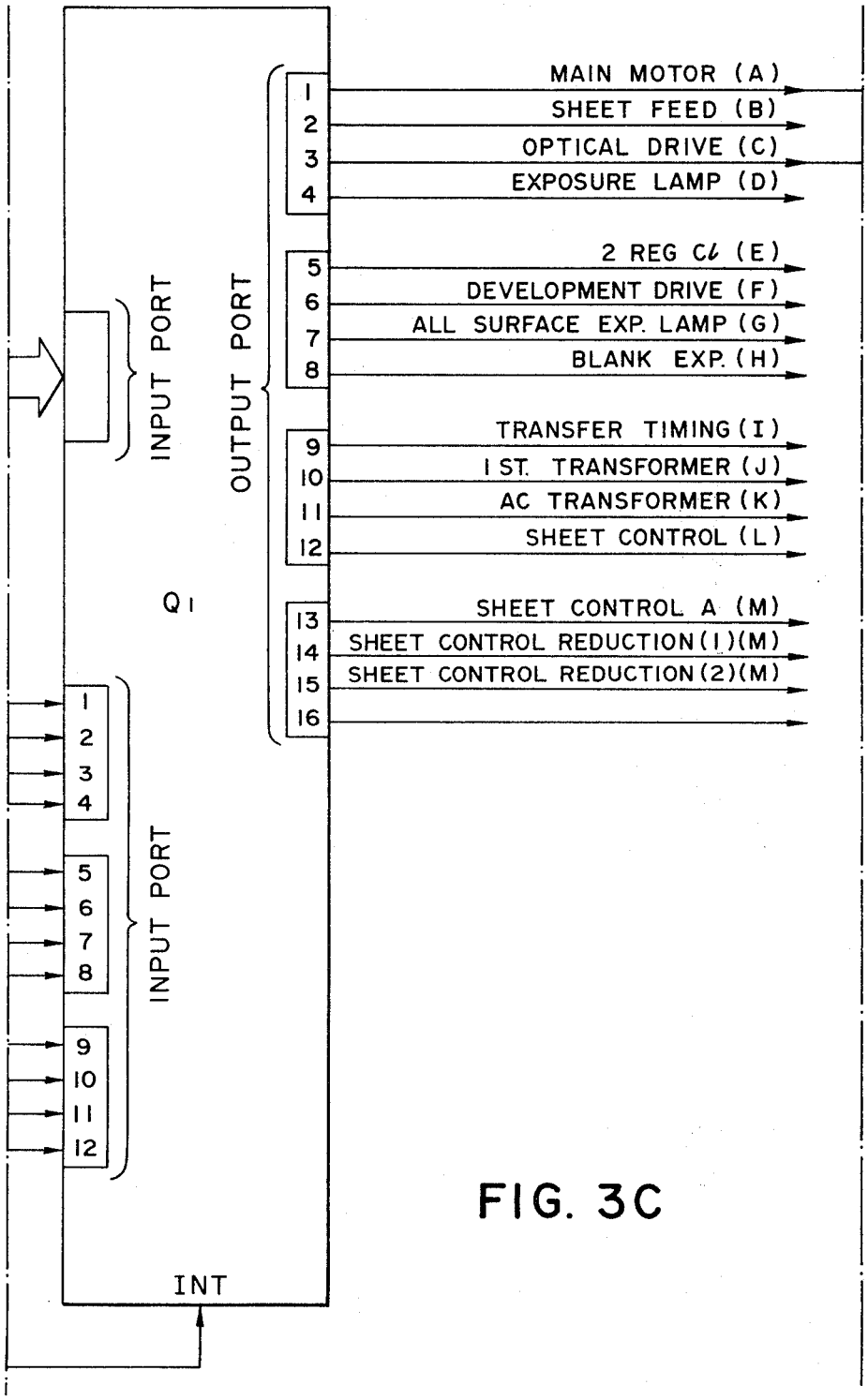
Figure 3D:
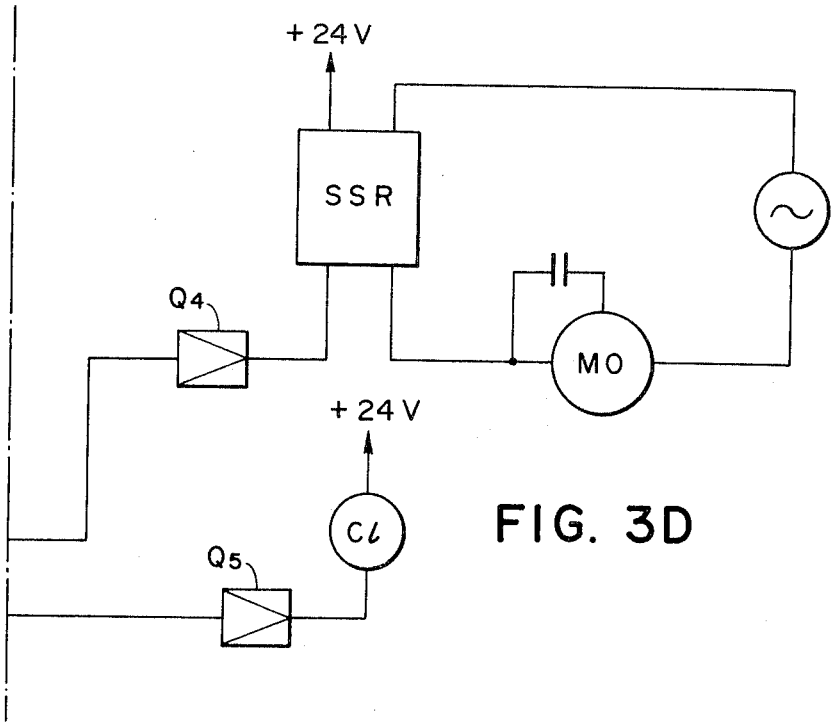

FIGS. 7A–7C through 9A–9B show the flowcharts of control procedure of this device and the operation command shown by said flowcharts is coded and memorized in the ROM of the controller $Q_1$ shown in FIGS. 3A–3B. This ROM is mask ROM whose content is unable to be converted.

Next, the copying operation control will be described by referring to the flowcharts of FIGS. 7A–7C through 9A–9B.

When first the power switch is turned on, the memory (RAM) is cleared in step 1. This memory ROM stores temporarily the data needed in copying operation and flags (abbreviated F/hereafter) which decide the course of the control steps in the execution of flowcharts. Next, in step 2, data 01 and 00 to be displayed first on the copy displayers 1H and 1G are input and displays are made in step 3, key and display. In key and display of step 3, control of each displayer of operation section and key input is made. In step 4, the decision whether or not this device has been set to sheet mode is made. In other words the signal 1 showing the sheet mode is generated by the sensor $S_5$ when the sheet original tray 55 is set to (A) state and procedure proceeds step 5. When the sheet original tray is not set to (A) state, procedure proceeds to step 9 passing through step 7. This case shows the book mode. When in step 4 it is decided that the mode has been set to the sheet mode, AF and 00 are respectively displayed on set displayers, or the copy displayers 1G and 1H, respectively in step 5, to display for the user that the mode is sheet mode. And F/AF is set because the mode has been set to sheet mode. Next, in step 6, decision of if any of reduction keys 1J was keyed in key and display of step 3 is made and, in the case where reduction key 1J has been depressed, F/reduction is set. It can be decided that reduction key is effective in steps 4, 5 and 6 only in sheet mode. In step 9, decision is made on the copy art mode of the main unit. This is done by deciding whether or not the signals of cassette paper empty, cassette empty, key counter or copying forbidden rate have been input to the input port 12 ($S_{10}$) of the controller $Q_1$ of FIG. 3. If the wait signal $S_{10}$ is a 1, procedure returns to (E) of the flowchart. If $S_{10}$ is a 0, procedure advances to the next step. In step 10, decision is made on whether or not the mode is sheet mode, and if F/AF is a 1, procedure advances to step 11 and, if a 0, procedure advances to step 12. In step 12, decision is made whether or not the copy button 1C has been depressed. In the case of sheet mode, by the action of the sensor $S_6$ which makes certain that the sheet original is set on the sheet original tray 55 in step 11, if the sheet original has not been set, procedure cannot advance to step 12 and the start of copy operation by copy button 1C cannot be made. The program flow of the device in standby state has been described.

Next, when the copy button 1C is depressed, the procedure proceeds to step 13. In step 13, decidion is made on whether or not the mode is sheet mode and, if decided reduction, reduction control is made and the procedure advances to step 14. In step 14 as shown the timing chart of FIGS. 5A, 5B, 6A and 6B, the main motor (A), overall exposure lamp (G), blank exposure (H), primary transformer (J), and AC transformer (K) are turned on, the 336 drum clock counting is set, and the count up in step 15 is waited for. The count of drum clock counting is of subtraction type and at the point where the carry of the counter is generated, the procedure advances to the next step. When count up is made in step 15, the exposure lamp (D) is turned on in step 16 to set 24 drum clock counting and counting is made in step 17. The paper feed (B) of the main unit starts after count up (steps 20 and 21) but the state related to copying stop is decided in advance. The decision is made in SUB STOP (step 18).

In SUB STOP (step 18) decision is made first on whether the wait signal $S_{10}$ or jam was generated, whether the stop key 1D of operation section was turned on, whether the interruption key 1E was turned ON (the interruption key is not accepted in sheet mode) and whether or not the sheet original tray 55 was set and then decision is made on whether copy stop state will be made in other words, whether F/STOP will be set or not. In the case where wait $S_{10}$, jam, or stop key 1D is depressed, F/STOP is set and in the case where interruption key 1E is depressed, F/interruption is set. In the case where sheet original tray 55 was set, F/AF interruption is set and then F/STEP is set. Next, whether to enter copy cycle or to enter rotary cycle after copy stop is decided by deciding the F/STOP of the step 19. In the case where F/STOP is set in SUB STOP (step 18) and decided in step 19, procedure jumps to (J). In the case F/STOP is 0, procedure advances to 20. At time of sheet mode in step 20, sheet control (L) and sheet control A(M) are turned on as shown in the timing chart of FIGS. 6A and 6B and procedure advances to step 21. When these L and M are turned on the sheet control rollers 56, 57, 62, 65, 66, 69 and 70 rotate to start conveyance of sheet original. In the case of not being sheet mode, procedure advances to step 21, turns on paper feed signal (B) and carrying timing (I) and the copying paper is fed from the cassette. Then 120 drum clock counting is set and procedure advances to steps 22 and 23. In steps 22 and 23, the sheet original is carried in the case of sheet mode by sheet control (L) and sheet control A(M) turned on by step 20, after confirming that the end of the sheet original was detected by the sensor $S_7$ (including oblique travel detection) the sheet control (L) is turned off (for the purpose of just coupling the copying paper of main unit and the resist) and the 208 drum clock counting is set on other counter for setting the timing of starting next sheet original carrying. When 120 drum clock counting is counted up in step 28 paper feed (B) is turned off in the next step. Step 24 is for judging resist sensor $S_4$ installed in optical system moving path and the second and subsequent sheets enter this flow. In step 25, judgement is made whether the copying mode is sheet mode or book mode and procedure proceeds to (F) in the sheet mode and to step 25 in the book mode.

First, the book mode will be described. After turning off paper feed (B), the 104 drum clock counting is set and, after counted up, optical drive (C) is turned on to set 144 drum clock counting. When the optical drive (C) is turned on, the original illuminating lamp 3 starts movement in order to give exposure to the original to be copied. The original illuminating lamp 3 stays at position of BHP sensor during stand-by period and moves toward OHP when it is started. OHP is used to take timing of original exposure start (timing related to resist) and the original illuminating lamp 3 is at position of BHP at time of ending copying. In step 28 the original illuminating lamp 3 it waited until it reaches the position of OHP which the counting of 144 drum clock is being made. When the lamp 3 has reached the position of OHP, the development drive (F) is turned on. If count up is made in step 29, procedure proceeds to step 30, decides in step 30 whether or not to set F/STOP by said SUB STOP and judges F/STOP in step 31. If F/STEP in step 31 is a 1, procedure proceeds to step 33, and if a 0, proceeds to step 32. In step 32 judgement is made to compare the number of sheets entered by operator to set display 1H as the desired number of sheets of copies with the number of sheets copied by copying operation. The copy counter displayer 1G may be incremented by +1 at the point paper feed is made to the main unit or may be incremented by +1 with other timing. Accordingly, whether the desired copy cycle has been ended or not is judged in step 32 and, in case not ended, procedure proceeds to (H), feeds paper, and continues copy cycle repeatedly. If the copy cycle is ended here, procedure proceeds to steps 33 and 34 and enters post rotation cycle.

The post rotation cycle includes the state control of each section that has been used in ended copying operation in preparation for next copying operation. If in step 33 the original illuminating lamp 3 operates the resist sensor $S_4$ the resist clutch (E) is turned on. In step 34 the arrival of original illuminating lamp 3 at position of BHP is waited and when it arrives, the optical drive (C) and resist clutch (E) are turned off, blank exposure (H) is turned on, 40 drum clock counting is set and counting up is judged in step 35. Procedure executes steps 36, 37, and 38 after counting up, turns off exposure lamp (D), development drive (F), primary transformer (J), AC transformer (K), main monitor (A), overall exposure lamp (G), and blank exposure (H) respectively and stops copying operation.

In sheet mode the procedure jumps to (F) by step 25. This is because the timing used in copying is different from that in book mode. In the case the procedure has jumped to (F) procedure proceeds to steps 46, 47 and 48 as shown by the time chart and judgement on whether or not the sheet mode copy cycle is ended is made in step 49. In step 49 the jugement is made by the F/STOP judgement in said SUB STOP and by the sensor $S_6$ which detects whether or not there is sheet original set on the sheet original tray 55. In the case where F/STOP is a 1, procedure passes the steps 50, 51, 52 and 53 completes the copying operation being executed, jumps to (G) and the copying is stopped. In the case where F/STOP is not a 1 and where sheet original is sensed absent on sheet original tray 55 by the sensor $S_6$, procedure proceeds to step 50 and when there is sheet original procedure jumps to (H), and continues copy cycle repeatedly.

Next, in the step 39 and thereafter whether or not an interruption was made in the copies is judged after ending copying. In this invention there are two means in interruption copy. One is the book mode interruption caused by setting sheet original tray 55 to point (A) of FIG. 1 while book copying is being made. The judgement of interruption is made in SUB STOP in pre-rotation cycle and copy cycle. As is clear from the flow in SUB STOP, while the sheet mode copying is being executed, in other words in the case in which F/AF (sheet mode) is set, interruption is not accepted. Accordingly only in book mode time interruption is accepted. For example, if interruption key 1E is depressed in the midst of copy cycle, F/interruption is set by SUB STOP, copy post rotation cycle begins and when the copy is stopped, it is judged by step 43, and procedure passes steps 44 and 41, resets F/interruption in step 44 and then sets F/interruption. In step 41 the number of set sheets, number of sheets of copies, and designated cassette selection at this point are stored in memory, and the procedure jumps to (D) in step 42, and in step 2 displays on the displays 1H and 1G newly the number of sheet set for interruption copying and number of sheets of copies. At this point the interruption display 1F goes on. And, at time of interruption copying, the interruption copying is started by newly inputting desired number of sheets of copies through the key 1A and by depressing the copy start button 1C. However no other interruption is accepted while the machine is engaging in interruption copying. When the interruption copying is ended, since F/interruption' is being set, the copying mode, which was previously being executed and stored by the memory in step 45, is recalled and the copying state is restored to the state before interruption, and F/interruption' is reset.

In the device having dual modes (sheet mode and book mode) which is the purpose of this invention, when the mode is changed to sheet mode while the book mode copying is being executed, it is handled as an interruption. The reason for this is as follows. Whether or not the mode is changed to sheet mode while book mode copying is being executed is judged by the sensor $S_5$ in SUB STOP and, in the case where sheet mode is set, F/AF interruption is set and the copy at time of interruption enters post rotation cycle and after ending the post rotation cycle procedure passes steps 40 and 41 by step 39, resets F/AF interruption, sets F/AF' interruption, and the number of set sheets and number of sheets of copies and designated cassette selection at that point are stored by the memory. Since F/AF' interruption is set in step 42 the procedure jumps to (C). When the procedure jumped to (C), AF and 00 are respectively displayed on SET displayers 1H and 1G to let the user know that the mode is now sheet mode. At this time the interruption lamp 1F goes on. Then sheet mode copying is performed, the sheet interruption copying is finished, the machine is in standby state, and when the sheet original tray 55 is returned to position (B) of FIG. 1 the procedure is advanced to step 7 by step 4, F/AF' interruption is judged in step 7, and if F/AF' interruption is found set, data about the number of sheet copies and size which were being executed before and have been stored in memory are recalled and the mode is restored to black mode copying enable state before the interruption, and F/AF' interruption is reset. According to this example the sheet mode interruption is acceptable only during book mode copying and interruption during stanby period is not handled as an interruption.

As is clear from the description given so far, in a copying device having a plural number of original exposure modes when, for example, an interruption in sheet mode is requested while the book mode copying is being executed, in other words when in a copying device which is executing book mode copying, the sheet original insertion table is set to the sheet mode using state, the device is stopped after completing the copying of the 1 cycle which is in operation at time of setting the insertion table, and the executing copying state such as the number of sheets of copies and size are stored to the memory and the device is brought automatically to the state ready for sheet mode copying. And, later the sheet mode interruption copying is ended and the insertion table is returned to book mode using state. This recalls the book mode copying state being executed before the interruption from the memory and the device is restored to the state before the interruption where sheet mode copying is possible. And by depressing the copy button, the copying operation which was being executed before interruption can be performed continuously again. In the case of sheet mode interruption, one sheet of copy is obtained each time the original is inserted.

It is also possible to perform sheet mode interruption by using the interruption key used at time of book mode interruption. In other words, sheet mode interruption becomes possible when the interruption key is operated after setting the sheet original insertion table. Moreover, also in a copying device where the sheet original insertion table is always in set state, sheet mode interruption is possible by the key used in book mode interruption.

When book mode interruption is requested while the device is executing book mode copying, by depressing the interruption key the copying of 1 cycle operation at time of depression is completed, the copying state at that point is memorized, and the device is stopped. Thereafter the number of sheets of copies and size which correspond to the interruption copying are set and interruption copying is started by the copy botton. When the book mode interruption copying is ended, the device automatically returns to the copying state before the interruption and, when further the copy button is depressed, the book mode copying which was being executed before interruption can be performed continuously. This applies also to the request for interruption copying of varied size copying. In the sheet mode copying from the point of view of the construction of this example in which one sheet of copy is obtained by inserting the original into the auto feeder one time, the number-of-sheets-of-copies displayer becomes unnecessary and used to show that the auto feeder is being used, or the sheet mode time. By letting the displayer display the copying state the displayers that have been installed individually in correspondence to the mode selection become unnecessary. Also in sheet mode time, if the inserted original has been jammed, the generation of feeder jam can be made known to the user by flashing the displayer.

Although in this example, the case where interruption copying can be made in a copying device having a plural number of original exposure modes was limited to the copying executing time of one mode, in other words, limited to the case where book mode copy is being executed, the request of interruption by book mode at time of executing sheet mode copying can be fulfilled by providing microswitch as the means of detecting the open and close operation of the original cover used in book mode copying by switching the copying device which is executing sheet mode copying to requested interruption mode by the signal from said microswitch, similar to the case of interruption by sheet mode while the device is executing book mode copying as described in the example and by restoring the device to the sheet mode copying state before the interruption and continuing copying operation after ending the interruption copying by book mode.

As has been described so far, this invention has various effects in the copying device which has a plural number of original exposure modes such as scan mode, varying size copying mode. Moreover, this invention is not limited to the examples described so far but contains various applicable modifications.

What I claim is:

1. A copying device comprising:

a first scanning means for exposing an original while it is being fed;

a second scanning means comprising a reciprocally moving member for exposing the original;

process means for performing a copying operation based on the exposed original image;

a guide member for being set to feed the original so that a copying operation by said first scanning means is performed; and control means responsive to said setting of said guide member, during a copying operation by said second scanning means, for suspending the copying operation being carried out so as to enable the copying operation by said first scanning means to be carried out, and to enable the copying operation by said second scanning means to be resumed after the completion of the copying operation by said first scanning means.

2. A copying device as set forth in claim 1 wherein said control means inhibits the copying operation by said second scanning means while said guide member is set.

3. A copying device as set forth in claim 1 wherein said guide member receives a plurality of sheet originals thereon, and said first scanning means continuously feeds the originals received on said guide member.

4. A copying device as set forth in claim 1 further comprising storage means for storing information regarding the copy operation being carried out at the time when said guide member is set, wherein said control means recalls the information stored in said storage means after the completion of the copying operation by said first scanning means.

5. A copying device as set forth in claim 4 wherein said storage means stores a desired number of copies, the number of copied sheets, and copy size.

6. A copying device as set forth in claim 4 wherein said control means recalls the information from said storage means in response to the resetting of said guide member.

7. A copying device having a plural number of copy modes comprising:

means for selecting one of said copy modes;

first control means responsive to the operation of said selecting means during a copying operation for causing the copying operation being executed to be suspended to permit a copying operation associated with the newly selected copy mode, and for causing the suspended copying operation to be resumed after completion of the copying operation associated with the selected copy mode; and second control means for permitting the control operation of said first control means during a copying operation associated with a first copy mode, and for inhibiting the control operation of said first control means during a copying operation associated with a second copy mode.

8. A copying device according to claim 7 further comprising means for storing information concerning the interrupted copying operation, wherein when the interrupted copying operation is resumed, the copying operation is carried out based on the information stored in said storage means.

9. A copying device having a plural number of copy modes comprising:

means for selecting one of said copy modes;

means for displaying information concerning a copying operation; and switching means responsive to the mode selection of said selecting means for switching the display content of said display means such that in a first mode a numeral is displayed, and in a second mode a mode-related signal is displayed.

10. A copying device according to claim 9 wherein said display means includes a display element having seven segments.

11. A copying device according to claim 9 further comprising means responsive to the mode selection of said selecting means for storing the information displayed on said display means.

12. A copying device comprising:

a first interrupting means for interrupting a copying operation being executed to permit a new copying operation according to a first mode;

a second interrupting means for interrupting a copying operation being executed to permit a new copying operation according to a second mode different from said first mode; and control means for inhibiting the copying operation according to said second interrupting means, while the copying operation according to said first interrupting means is performed.

13. A copying device according to claim 12 wherein after the completion of the copying operation according to said first and second interrupting means, the copying operation according to the copy mode before the interruption is resumed.

* * * * *

UNITED STATES PATENT AND TRADEMARK OFFICE

CERTIFICATE OF CORRECTION

PATENT NO. : 4,403,850

DATED : September 13, 1983

INVENTOR(S) : SHUNICHI MASUDA

It is certified that error appears in the above-identified patent and that said Letters Patent is hereby corrected as shown below:

COLUMN 1

Lines 29 and 34, "other" should read --another--.

Line 38, "is focused to" should read --must--.

Lines 49, 54 and 62, "objection" should read --object--.

COLUMN 2

Lines 1, 9 and 14, "objection" should read --object--.

Line 56, "a" should read --an--.

Line 65, before "charged" insert --is--.

COLUMN 3

Lines 7 and 9, after "toward" insert --the--.

Line 16, before "moving" insert --and--.

Line 17, after "stop" insert --their--.

Line 20, after "copying" insert --of the--.

COLUMN 4

Line 35, "pain" should read --pair--.

Line 48, after "having" insert --and--.

UNITED STATES PATENT AND TRADEMARK OFFICE

CERTIFICATE OF CORRECTION

PATENT NO. : 4,403,850

DATED : September 13, 1983

INVENTOR(S) : SHUNICHI MASUDA

It is certified that error appears in the above-identified patent and that said Letters Patent is hereby corrected as shown below:

COLUMN 5

Line 12, "original $O_s$ is" should read --originals $O_s$ are--.

Line 16, "fed to" should read --fed--.

Line 17, after "detected" insert --at--.

Lines 43 and 44, "original" should read --originals--.

Line 54, "with" should read --which--.

COLUMN 6

Line 18, "resist" should read --resistance--.

Line 24, "outofeeder" should read --autofeeder--.

Line 44, "all time" should read --at all times--.

Lines 32, 33 and 35, "sheet" should read --sheets--.

COLUMN 7

Line 7, "to" should read --in--.

Line 13, "At time of sheet mode" should read --At the time of sheet mode copying--.

Line 14, ". Because" should read --, because--.

Line 17, "all time" should read --at all times--.

UNITED STATES PATENT AND TRADEMARK OFFICE

CERTIFICATE OF CORRECTION

PATENT NO. : 4,403,850

DATED : September 13, 1983

INVENTOR(S) : SHUNICHI MASUDA

It is certified that error appears in the above-identified patent and that said Letters Patent is hereby corrected as shown below:

COLUMN 7 (Continued)

Line 24, after "as" insert --of--.

Line 34, "refeased" should read --released--.

Line 61, "examle" should read --example--.

COLUMN 8

Line 8, "singal" should read --signal--.

Line 11, "made" should read --mode--.

Line 36, after "proceeds" insert --to--

Line 45, delete "of"

Line 46, "keys" should read --key--.

COLUMN 9

Line 2, "decidion" should read --decision--.

Line 4, delete "decided reduction";

after "is" insert --to be--.

Line 5, before "the" insert --in--.

COLUMN 10

Line 9, "it waited" should read --waits--.

UNITED STATES PATENT AND TRADEMARK OFFICE

CERTIFICATE OF CORRECTION

PATENT NO. : 4,403,850

DATED : September 13, 1983

INVENTOR(S) : SHUNICHI MASUDA

It is certified that error appears in the above-identified patent and that said Letters Patent is hereby corrected as shown below:

COLUMN 10

Line 10, before "which" insert --in--.

Line 36, "waited" should read --delayed--.

Line 47, "In the case" should read --When--.

Line 51, "jugement" should read --judgment--.

COLUMN 11

Line 58, "black" should read --book--;

after "state" insert --which existed--.

Line 62, "stanby" should read --standby--.

COLUMN 12

Line 46, after "one" insert --at a --.

UNITED STATES PATENT AND TRADEMARK OFFICE

CERTIFICATE OF CORRECTION

PATENT NO. : 4,403,850

DATED : September 13, 1983

INVENTOR(S) : SHUNICHI MASUDA

It is certified that error appears in the above-identified patent and that said Letters Patent is hereby corrected as shown below:

COLUMN 13

Line 9, before "varying" insert --and--.

Signed and Sealed this

Tenth Day of April 1984

[SEAL]

Attest:

GERALD J. MOSSINGHOFF

Attesting Officer

Commissioner of Patents and Trademarks